US009207616B2

(12) United States Patent
Kumazawa

(10) Patent No.: US 9,207,616 B2
(45) Date of Patent: Dec. 8, 2015

(54) AUTOMATIC ORIGINAL COVER OPERATOR OF A COPYING MACHINE

(75) Inventor: Keizo Kumazawa, Kanagawa (JP)

(73) Assignee: KEM HONGKONG LIMITED, Tsimshatsui Kowloon (HK)

( * ) Notice: Subject to any disclaimer, the term of this patent is extended or adjusted under 35 U.S.C. 154(b) by 467 days.

(21) Appl. No.: 12/886,720

(22) Filed: Sep. 21, 2010

(65) Prior Publication Data

US 2011/0072727 A1 Mar. 31, 2011

(30) Foreign Application Priority Data

Sep. 25, 2009 (JP) ..... 2009-221571

(51) Int. Cl.
*G03G 15/00* (2006.01)

(52) U.S. Cl.
CPC ..... *G03G 15/605* (2013.01); *Y10T 16/304* (2015.01); *Y10T 16/56* (2015.01); *Y10T 16/593* (2015.01)

(58) Field of Classification Search
USPC ..... 49/333, 334, 335, 358; 16/294; 399/380
IPC ..... G03G 15/605; Y10T 16/593,16/56, Y10T 16/304
See application file for complete search history.

(56) References Cited

U.S. PATENT DOCUMENTS 2,170,014 A * 8/1939 Ellis ..... 49/30
2,230,783 A * 2/1941 Parsons et al. ..... 49/253
2,865,629 A * 12/1958 Henkel ..... 49/276
7,320,462 B2 * 1/2008 Takamatsu ..... 271/3.14
7,440,712 B2 * 10/2008 Uchida ..... 399/107
7,512,376 B2 * 3/2009 Suzuki ..... 399/380
7,900,320 B2 * 3/2011 Katsumata et al. ..... 16/286
8,139,994 B2 * 3/2012 Suzuki ..... 399/380
2006/0180972 A1 * 8/2006 Suzuki ..... 271/3.14
2009/0034208 A1 * 2/2009 Suzuki ..... 361/725
2009/0300878 A1 * 12/2009 Suzuki ..... 16/71

FOREIGN PATENT DOCUMENTS

JP 2009-36994 2/2009
JP 2009-122141 6/2009

* cited by examiner

*Primary Examiner* — Gregory Strimbu
(74) *Attorney, Agent, or Firm* — Notaro, Michalos & Zaccaria P.C.

(57) ABSTRACT

An automatic original cover operator of a copying machine, includes a hinge part and a driving part. The hinge part includes a mounting member attached to the main body of the copying machine, a supporting member rotatably mounted on the mounting member via a main shaft, a lifting member rotatably mounted on side plates of the supporting member via a drive shaft, a part for controlling rotation of the hinge part, the part for controlling rotation serving to urge the supporting member in an opening direction of the original cover and the lifting member to overlap the supporting member, and a rotation controlling mechanism for the lifting member. The driving part includes a drive case, a drive motor mounted in the drive case, and a reduction mechanism mounted in the drive case for transmitting a rotation drive force from the drive motor to the main shaft.

4 Claims, 34 Drawing Sheets

AUTOMATIC ORIGINAL COVER OPERATOR OF A COPYING MACHINE

FIELD OF THE INVENTION

The present invention relates to an automatic original cover operator of an original cover, suitable in use for automatically opening and closing the original cover with regard to a main body of a copying machine, as the type of office equipment using the automatic original cover operator.

BACKGROUND ART

In a copying machine, in particular large one, as a sort of office equipment being opened/closed member, an opening/closing device of a heavy opening/closing member weighing some 20-30 kg, in particular an original cover (mostly equipped with automatic original feeder) is provided; among such opening/closing devices of opening/closing members, an automatic opening/closing device of original cover is desirable, wherein the device enables an original cover to automatically open and close, for improving its operability in response to the weight of original cover and for facilitating operations by an operator in wheelchair, which is not necessarily the case of a heavy original cover. Among automatic opening/closing devices of original covers as above described, the ones disclosed in JP Laid-Open Patent Publications No. 2009-122141 and 2009-036994 are publicly known.

An automatic opening/closing device of original cover disclosed in JP Laid-Open Patent Publication No. 2009-122141 mentioned above comprises a driving part including a drive motor being a power source, wherein the driving part is mounted on the main body side, and an power output generated by the driving part is transmitted to a connecting shaft also functioning as a hinge pin of a supporting member for supporting the original cover with regard to a mounting member, so that the original cover is opened and closed via the supporting member which rotates.

The automatic opening/closing device of original cover assembled in this manner is not desirable in terms of appearance since the driving part still protrudes on the main body side when the original cover is opened, and the automatic opening/closing device further necessitates design changes on a main body. Therefore, it is not so widespread. In recent years, specialization is advanced for copying machine, and separate specialized manufacturers produce main body, original cover with automatic original feeder and opening/closing device of original cover for opening/closing original cover with regard to main body respectively; first, a manufacturer of original cover mounts opening/closing devices of original cover on the original covers, and then the one for copying machine purchases original covers with opening/closing devices and assembles them to main bodies.

Therefore, an automatic opening/closing device of original cover is developed, wherein a driving part mechanically independent from a main body is mounted on a mounting member of a hinge part, as disclosed in JP Laid-Open Patent Publication No. 2009-036994. The automatic opening/closing device of this sort has an advantage in that it does not impose design changes on the main body in installing the driving part. However, even this opening/closing device has not resolved the problem of undesirable appearance yet, since the driving part remains exposed on the main body when the original cover is opened.

Moreover, there is also problem in that maintenance requires additional steps and is thus complicated, since the driving part together with the hinge part should be removed from the main body, when the original cover needs to be removed from the main body for repair and inspection.

SUMMARY OF THE INVENTION

The present invention considers the above-mentioned points. It is an object of the invention to provide an automatic original cover operator of original cover, wherein it is only necessary to negotiate with a design section of manufacturer of original cover when an approval is made to an automatic original cover operator of original cover being original cover of an office equipment such as copying machine, a driving part is not exposed so as to protrude on a main body (opened/closed member) when the original cover (opening/closing member) is opened, and a removal of the original cover during maintenance is facilitated.

In order to achieve the above-mentioned tasks, the present invention solves the above-mentioned problems by the following means:

The first aspect of the invention is characterized in that an automatic original cover operator automatically opening and closing an original cover via said hinge part and said driving part with regard to a main body of an office equipment: said hinge part comprising at least; a mounting member mounted on said main body of said office equipment, a supporting member connected to said mounting member via a main shaft so as to rotate with regard to said main shaft, a second means for controlling rotation, said second means for controlling rotation serving to urge said supporting member in an opening direction of said original cover between said mounting member and said supporting member, a lifting member mounted on a free end side of said supporting member so as to rotate in a direction contrary to a rotational direction of said supporting member, and a first means for controlling rotation, said first means for controlling rotation serving to allow for a rotation of said lifting member, exclusively when a predetermined rotation torque is applied; and said driving part comprising: a drive case mounted on said main shaft and said connecting shaft, a drive motor so mounted in said drive case that said drive motor is rotatable about said main shaft, and a reduction mechanism mounted in said drive case and transmitting rotation drive force from a rotation axis to said main shaft via an electromagnetic clutch means; so that said driving part is rotatable together with said supporting member when said original cover opens and closes.

Next, the invention is characterized in that the opened/closed member is a main body of an office equipment and the opening/closing member is an original cover, and that for this purpose the hinge part comprises at least a mounting member mounted on the side of the main body and a supporting member of the original cover rotatably mounted on the mounting member, and the driving part mechanically independent from the opened/closed member is mounted on the side of the opening/closing member and so designed that it rotates together with the original cover, when the opening/closing member opens and closes.

Next, the invention is characterized in that the hinge part comprises at least the mounting member mounted on the side of the main body and the supporting member of the original cover rotatably mounted on the mounting member, a lifting member mounted on a free end side of the supporting member so as to be rotatable in a direction contrary to the supporting member and a first means for controlling rotation, said first means for controlling rotation serving to allow for a rotation of the lifting member, exclusively when a predetermined rotation torque is applied.

The second aspect of the invention is characterized in that the hinge part further comprises the means for restricting control serving to allow for the rotation of the lifting member, exclusively when the predetermined rotation angle is applied.

The third aspect of the invention is characterized in that the first means for controlling rotation is a compression spring resiliently provided between the side of the mounting member and an actuating member provided at a position different from a pivotally supported position of the lifting member with regard to the supporting member.

The fourth aspect of the invention is characterized in that the first rotation control means is a compression spring resiliently provided between the lifting member and the supporting member.

The fifth aspect of the invention is characterized in that the second means for controlling rotation is a compression spring resiliently provided between the side of the mounting member and a free end side of the supporting member.

The sixth aspect of the invention is characterized in that the second means for controlling rotation is a compression spring resiliently provided between the side of the mounting member and the actuating member provided at the position different from the pivotally supported position of the lifting member with regard to the supporting member.

The seventh aspect of the invention is characterized in that the second means for controlling rotation comprises a first spring receiving member swingably supported on said mounting member via locking pins, a second spring receiving member slidably accommodating said first spring receiving member and swingably mounted so as be swingable with regard to an actuating member mounted on said lifting member, and a compression spring resiliently provided in said first spring receiving member and said second spring receiving member The eighth aspect of the invention is characterized in that the second means for controlling rotation is equipped with a fluid damper device operating at the predetermined closing angle of the document pressing plate with regard to the office equipment.

The ninth aspect of the invention is characterized in that the rotation controlling mechanism for said lifting member comprises a first locking member having engagement recess portions on one end portion of a main shaft, engagement convex portions overlapping the first locking member and rotatably mounted on the main shaft, wherein engagement convex portions are engaged with the engagement recess portions depending on a rotational angle of the main shaft, as well as a second locking member having an engagement portion engaged with a locking pin mounted on a lifting member and releasing from an engagement by the locking pin, depending on a rotational angle of the main shaft, and tension spring rotatably urging the second locking member in one direction.

The tenth aspect of the invention is characterized in that the driving part comprises distortion detecting means mounted on a connecting shaft and a main shaft connected with the hinge part.

The eleventh aspect of the invention is characterized by an office equipment, which is equipped with the automatic original cover operator according to the first aspect of the invention As above described, the driving part is provided on the side of the supporting members(s) of the original cover being the opening/closing member and/or a hinge part in accordance with the invention, so that the invention will be feasible only by negotiations on design with manufacturer of the original cover. Therefore, the invention is advantageous in that complicated operations are eliminated and it is highly feasible. It is further advantageous in that the driving part does not remain protruding on the main body, that the appearance is slimmed down, and that repair and maintenance of the main body are facilitated in comparison to the device requiring further detachment and attachment of the driving part from the hinge part as is the case of the conventional ones, since the entire driving part can be separated from the main body in removal of the original cover from the main body during repair and maintenance. Moreover, when in the invention an operating point via the driving part is provided on a free end side of the supporting member of the hinge part or a tip side of the drive case, as in an embodiment 1 described hereinafter, it is advantageous in that the drive motor can be downsized and provided at a reduced cost, since rotation torque during opening and closing of the original cover is reduced due to a location of the operating point on a fore side of the hinge part.

Figure 1:
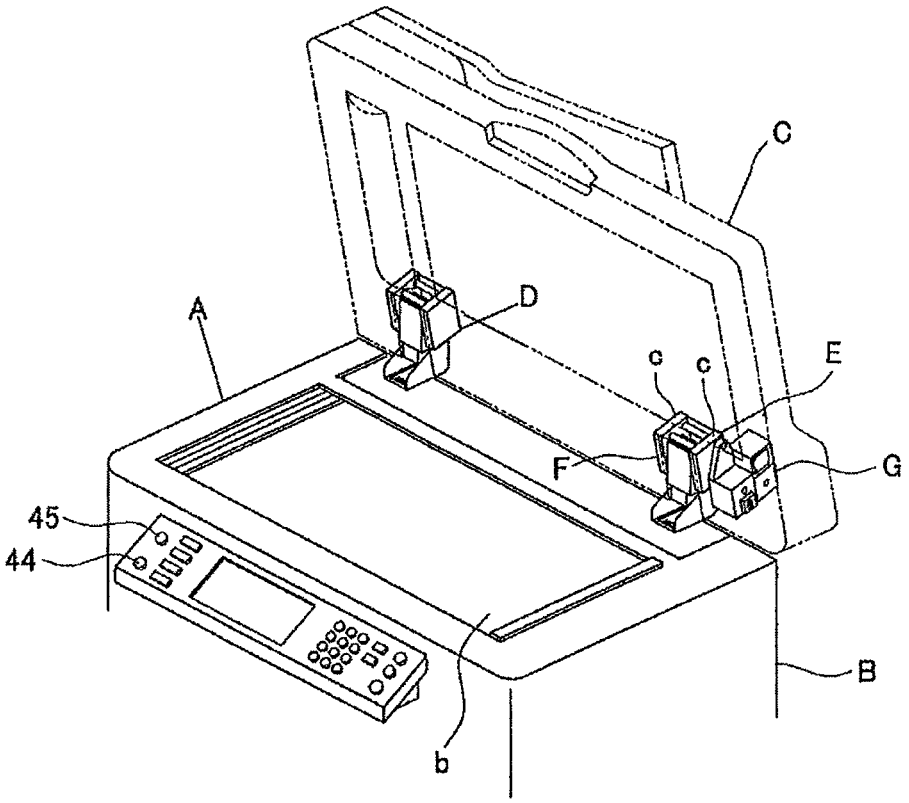
FIG. 1 is a perspective view showing the state in use of a copying machine in an embodiment of the present invention.
Figure 2:
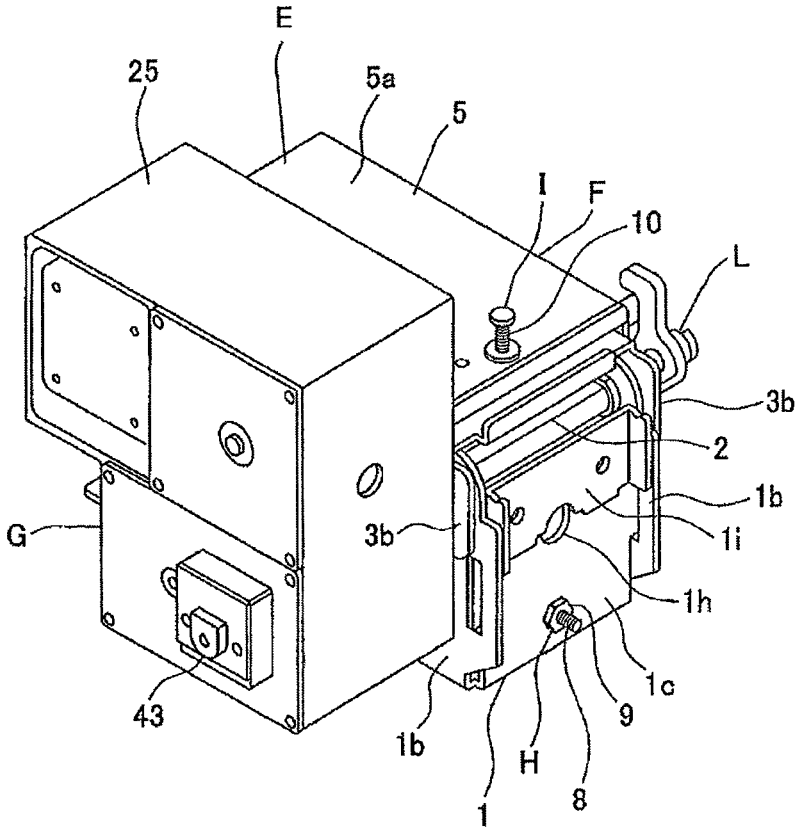
FIG. 2 is a perspective view of an automatic opening/closing device according to the present invention.
Figure 3:
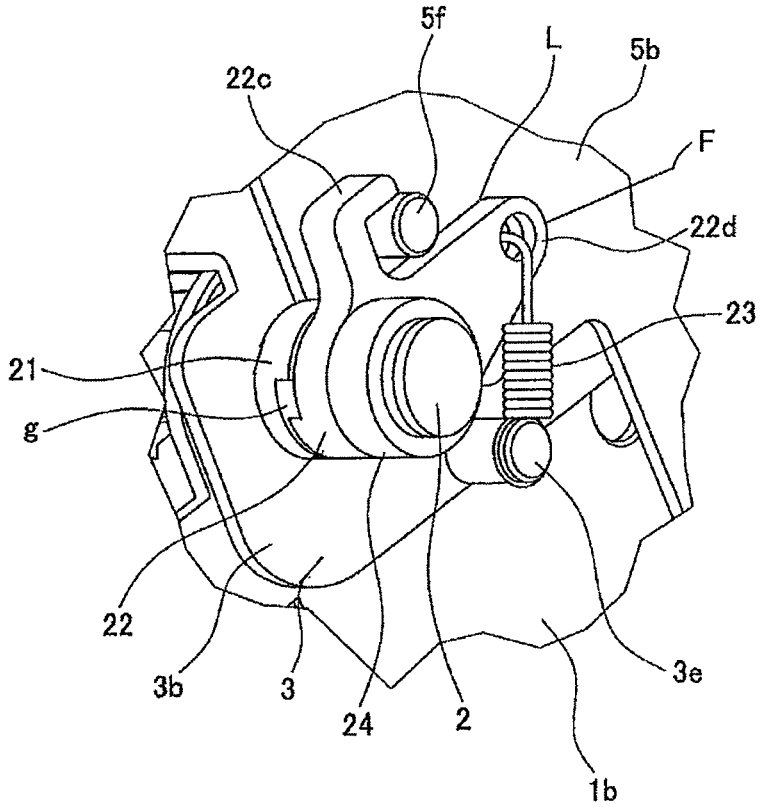
FIG. 3 is an enlarged perspective view of a rotation controlling mechanism of a lifting member according to the present invention.
Figure 4:
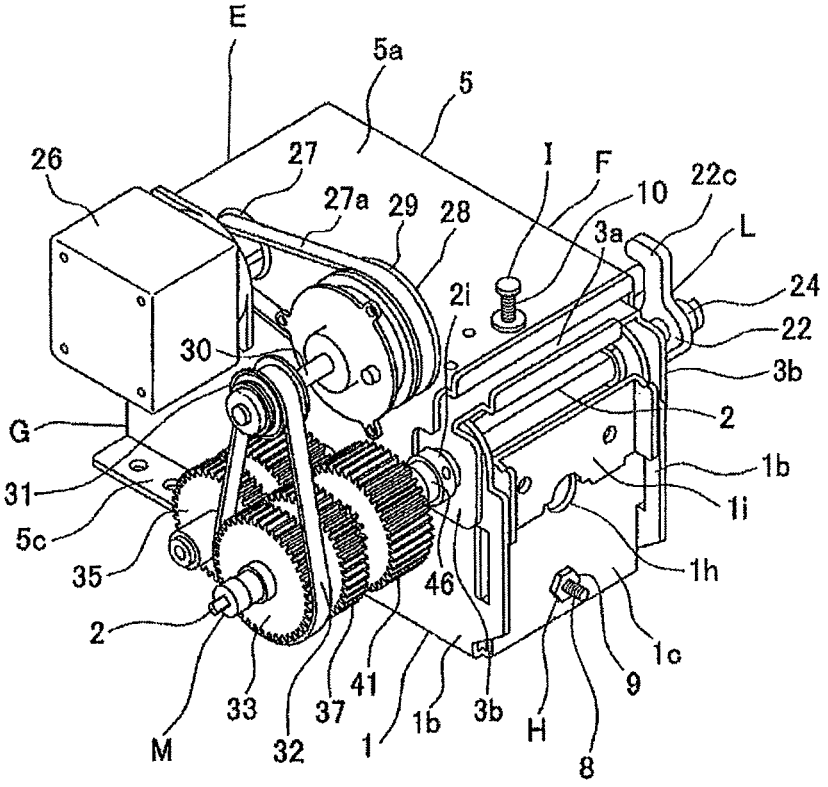
FIG. 4 is a perspective view of an automatic opening/closing device according to the present invention, as shown without a drive case of a driving part.
Figure 5:
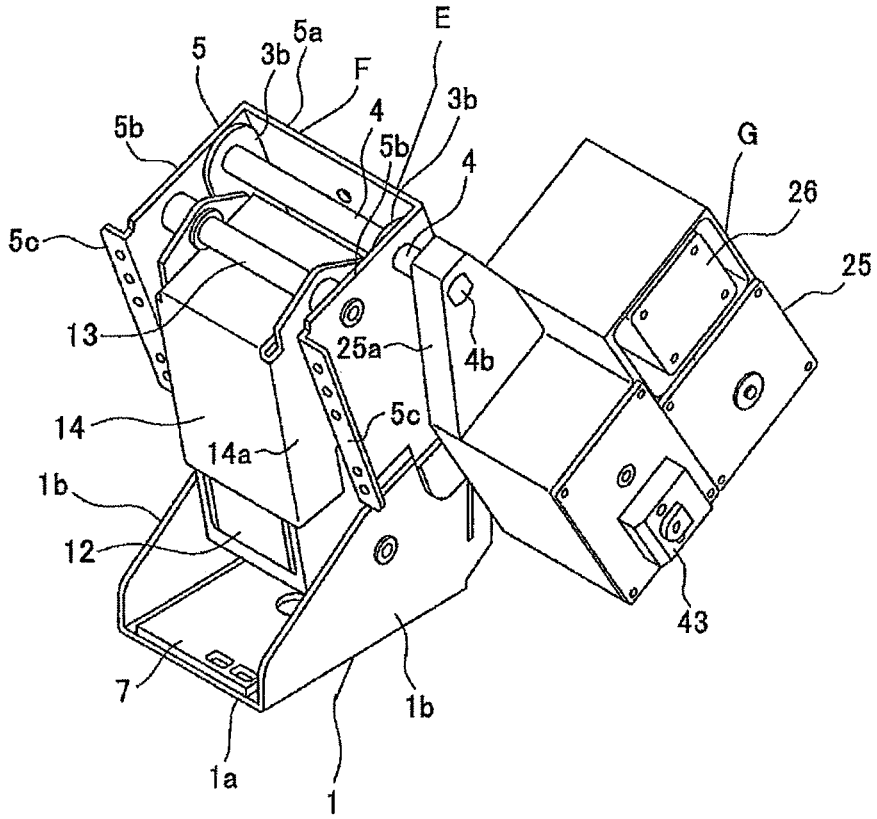
FIG. 5 is a perspective view showing operation of an automatic opening/closing device according to the present invention.

A main body as an opened/closed member implementing the present invention is most preferable when it is a main body for a copying machine among various sorts of office equipment, however, it is not particularly limited thereto but may be implemented as main body of other sorts of office equipment such as printing machine, printer and scanner and other opened/closed members.

Further, an opening/closing member according to the present invention is preferably 20-30 kg, but not limited thereto. It may be lighter, e.g., 3-5 kg, and may be further applied in general to an opening/closing member of opened/closed member.

Still further, an automatic opening/closing device implementing the present invention is not limited to an automatic opening/closing device of an original cover with regard to a main body of a copying machine, as illustrated in the following embodiments, but may be implemented to objects in other various publicly known layouts.

Still further, a hinge part is not limited to the ones described in the following embodiments. Basically it works only with the mounting member and the supporting member rotatably mounted on it. Moreover, layouts of a first and a second means for controlling rotation are not limited to the ones in the embodiments. Various publicly known layouts may be used for this purpose.

Additionally, the present invention is implemented to the one on the right of a pair of hinge parts on both sides, but not limited thereto and does not hinder from implementing the invention to a hinge part on the left.

In addition, concerning components of a hinge part, although a rotation controlling mechanism of an additionally provided lifting member would be useful in copying a thick document such as a book, the hinge part does work even without such a means.

Further, although a lifting member is useful if additionally provided, an original cover may be lifted even without it, e.g. by mounting a mounting member in a one-leg shape into a mounting hole provided on the side of a main body, and by mounting a mounting member so as to be vertically movable. In this case, the lifting member may be omitted. A hinge part according to the present invention includes the one with no lifting member.

Embodiments are hereinafter described for the ones related to a driving part separated from a side of a main body and provided on a supporting member side of an original cover and/or a hinge part, wherein the original cover is mounted on the supporting member or a lifting member rotatably mounted on the supporting member and a drive case of the driving part is mounted on the hinge part side so as to rotate together with the supporting member. However, another embodiment can be also conceived, wherein the drive case or a case cover is directly mounted on the original cover, without using the supporting member. Moreover, drive cases can be also mounted on both the supporting member and the original cover.

EMBODIMENT 1

Hereinafter, embodiment 1 of the present invention is described based on the accompanying drawings. In FIGS. 1 to 21, FIG. 1 shows a copying machine, as an example of an office equipment in an embodiment of the present invention. In drawings, reference character A denotes a copying machine which comprises a main body B as an opened/closed member, as well as e.g. an original cover C as an opening/closing member equipped with an automatic original feeder, an opening/closing device D of original cover located on the left if the observer faces the main body B, for openably/closably mounting the original cover C on the main body B, and an automatic opening/closing device E of the original cover (opening/closing member) C according to the present invention located on the right. In the meantime, the automatic opening/closing device E is mounted on the right if the observer faces the main body B of the copying machine A, it may be also mounted on the left, as stated above. However, if the automatic opening/closing device E is mounted on the right of the main body B of the copying machine A, the embodiment is advantageous in that a driving part G can be easily installed even without remarkable change in layout, since the right hand side of the original cover C is not equipped with an automatic original feeder, thus being a so-called open area. On the other hand, the automatic original cover operator E mounted on the left is advantageous in that the arrangement without the device can be maintained in automatically opening and closing the original cover C, with an automatic original cover operator E being mounted on the side with a greater load. This is because the original cover operator D of original cover on the left is originally intended to be large in order to support the weight of the automatic original feeder installed on the left and the small original cover operator is mounted on the right.

In the following description, reference will be made to an embodiment wherein an automatic opening/closing device E is installed on the right if the observer faces a main body B of a copying machine A. However, it is not limited thereto, as above stated.

An automatic opening/closing device E of an original cover C according to the present invention is characterized, in particular as shown in FIG. 1, in that a driving part G thereof is provided on a side of the original cover C. In other words, the automatic opening/closing device E according to the present invention comprises a hinge part F and the driving part G thereof, and is characterized in that the driving part G is installed on the original cover C. In the meantime, the one of publicly known layout is used for an opening/closing device D of original cover, therefore detailed illustration and description in this regard are omitted.

A hinge part F of an automatic opening/closing device E according to the present invention is also of publicly known layout except a rotation controlling mechanism L for a lifting member 5, however, reference is made to the hinge part F, since the operation thereof cooperates with a driving part G. The hinge part F comprises, in particular as shown in FIGS. 1 to 15, a mounting member 1 detachably mounted via a mounting button b on an upper end of a rear portion of a main body B, a supporting member 3 rotatably mounted via a main shaft 2 also serving as hinge pin on the mounting member 1, a lifting member 5 mounted via a connecting shaft 4 also serving as hinge pin on a free end side of the supporting member 3 so as to rotate in a direction contrary to the supporting member 3, a second means for controlling rotation K provided between a side of the mounting member 1 and an actuating member 13 mounted on the lifting member 5, a rotation controlling mechanism L for the lifting member 5 provided between a free end side of the lifting member 5 and the supporting member 3.

Described further in detail, a mounting member 1 comprises a bottom plate 1*a*, both side plates 1*b*, 1*b* extending upward perpendicular to both sides of the bottom plate 1*a* and a rear plate 1*c* extending upward perpendicular to a rear portion of the bottom plate 1*a* and locked between the both side plates 1*b*, 1*b*. The bottom plate 1*a* is provided with a mounting hole 1*d* on a substantially central portion of a rear end portion and with mounting long holes 1*e*, 1*e* elongated in a longitudinal direction on a fore end portion side. The both side plates 1*b*, 1*b* are provided with coupling holes 1*f*, 1*f* for the main shaft 2 and with locking holes 1*g*, 1*g* which locks locking pins 11 of a first spring receiving member 12 described below.

A mounting member 1 as above described is provided with a mounting position adjusting means H for adjusting a mounting position of the mounting member 1 with regard to a main body B. The mounting position adjusting means H comprises an adjusting plate 7 overlapping a bottom plate 1*a* of a mounting member 1 and an adjusting screw 8 screwed into a rear plate 1*c* of the mounting member 1, and the adjusting plate 7 has a locking piece 7*a*, a first adjusting long hole 7*b* which is so located on the side of the locking piece 7*a* that the axial center thereof overlaps that of a mounting hole 1*d*, and second adjusting long holes 7*d*, 7*d* elongated in a horizontal direction and overlapping mounting long holes 1*e*, 1*e* on the fore end side, wherein a circumferential groove 8*a* provided on the adjusting screw 8 is engaged with a recess portion 7*c* provided on the locking piece 7*a* of the adjusting plate 7. Reference numerals 7*e*, 7*e* denote mounting screws. A nut 9 for clamping is also mounted on the adjusting screw 8. Moreover, the rear plate 1*c* of the mounting member 1 is provided with a through hole 1*h* used in screwing an adjusting screw 18 as described below with driver, hex wrench or other tool, and an opening angle adjusting plate 1*i* is mounted on it. Reference numerals 1*j*, 1*j* as shown in particular in FIG. 6 denote fixing members inserted and fixed into coupling holes 1*f*, if provided on both side plates 1*b*, 1*b* of the mounting member 1, while reference numerals 1*k*, 1*k* denote bearing members mounted in first coupling holes 3*c*, 3*c* provided on the both side plates 3*b*, 3*b* of the supporting member 3.

Figure 6:
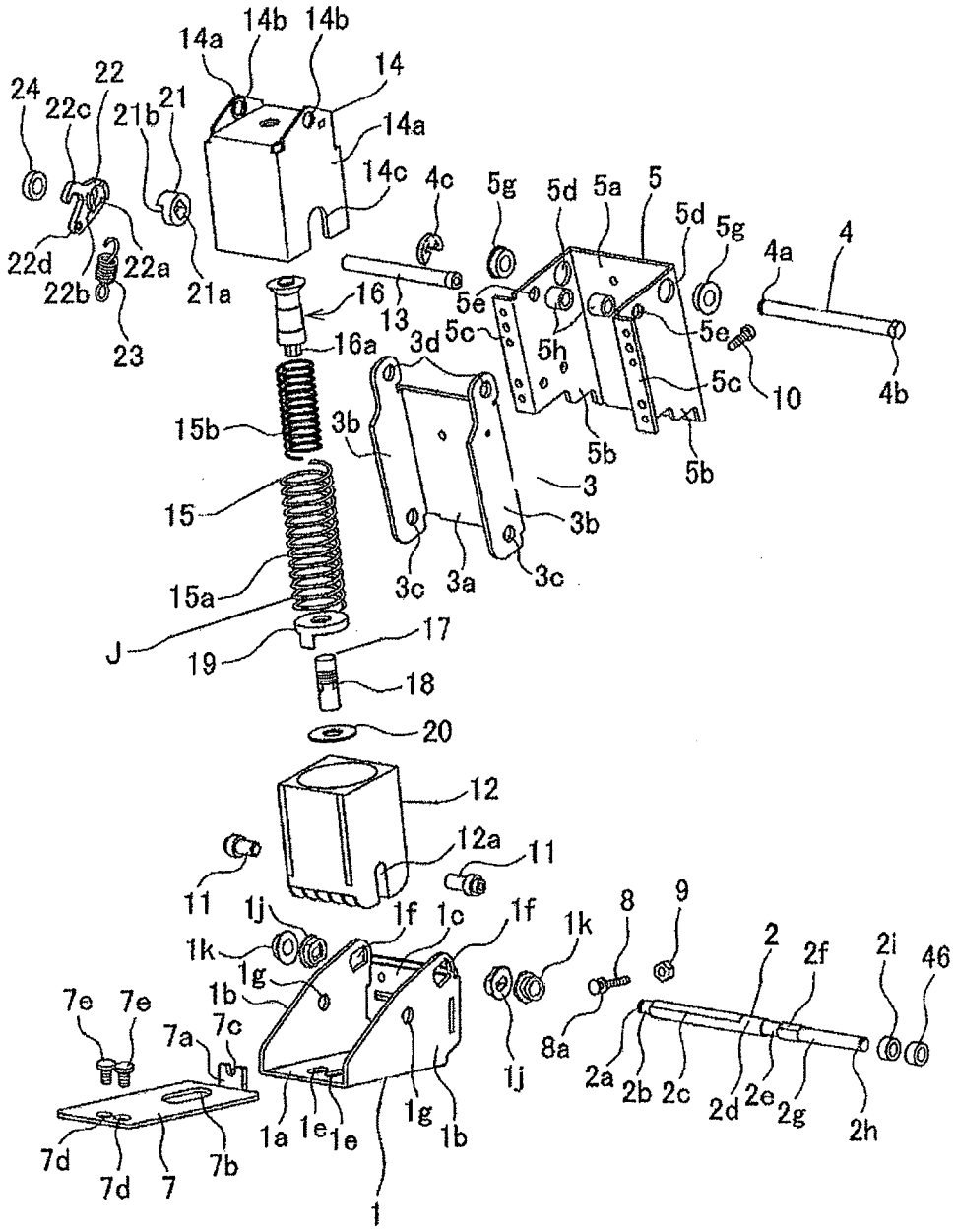
FIG. 6 is an exploded perspective view of an automatic opening/closing device according to the present invention, in particular of an area of a hinge part.
Figure 7:
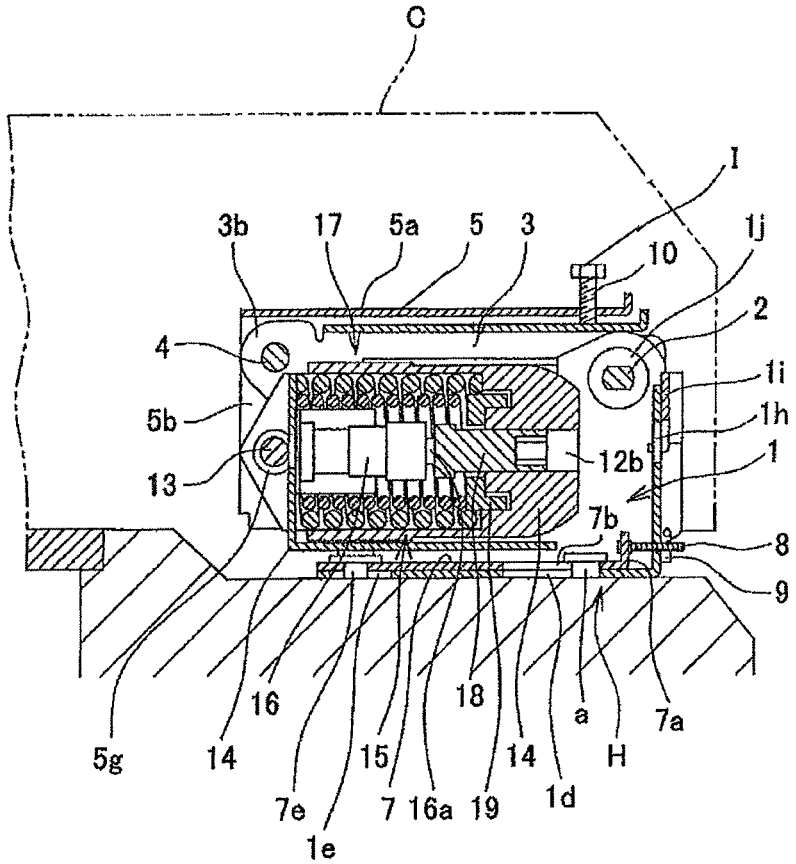
FIG. 7 is a sectional view of an area of a hinge part of an automatic opening/closing device according to the present invention.
Figure 13:
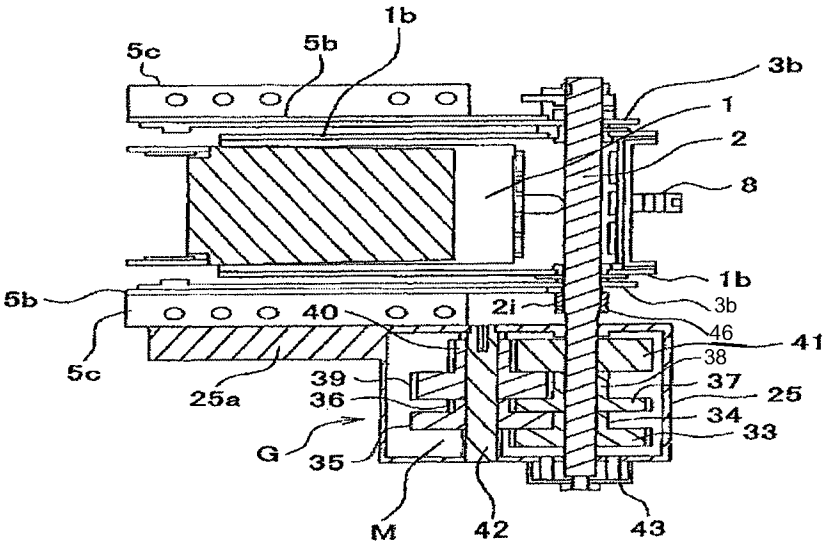
FIG. 13 is a sectional view of FIG. 11 in line 13-13.
Figure 14:
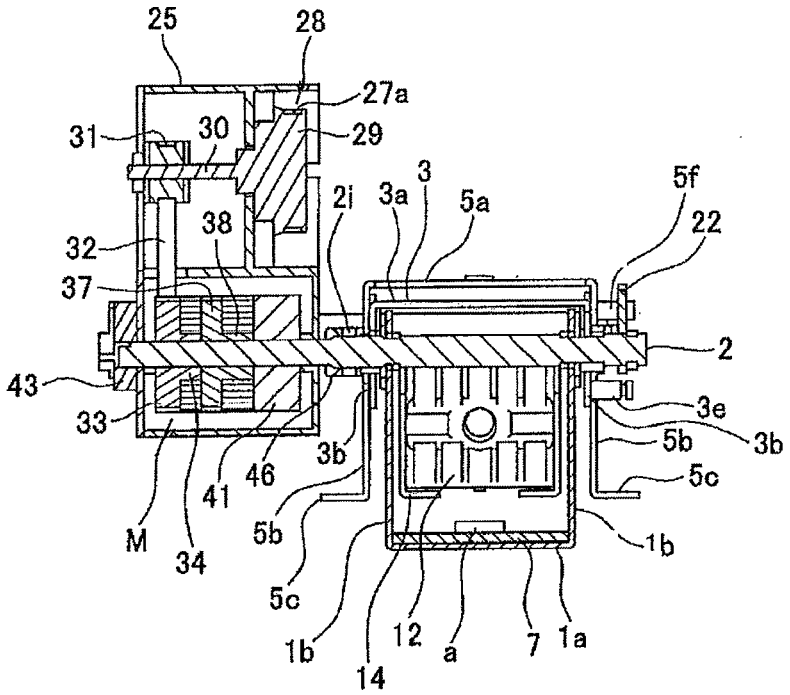
FIG. 14 is a sectional view of FIG. 11 in line 14-14.
Figure 15:
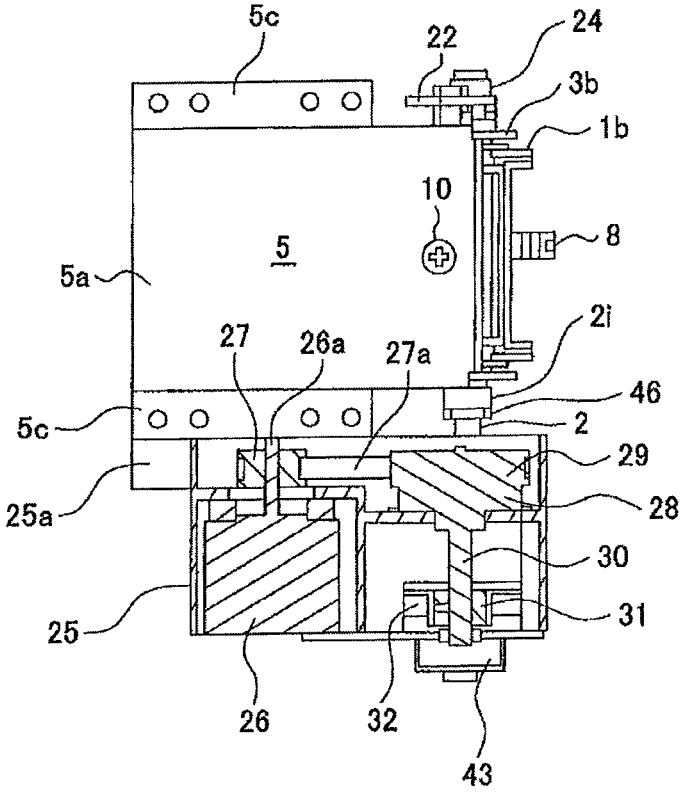
FIG. 15 is a sectional view of FIG. 11 in line 15-15.
Figure 16A:
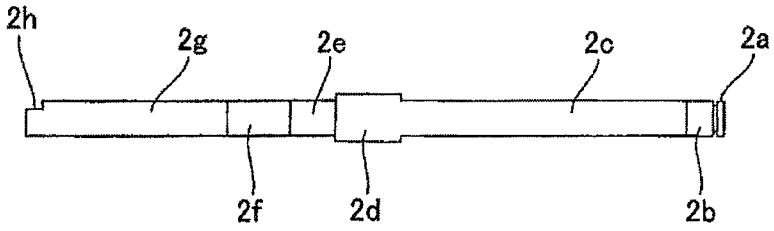
FIG. 16A is an elevation view of a main shaft of an automatic original cover operator according to the present invention.
Figure 16B:
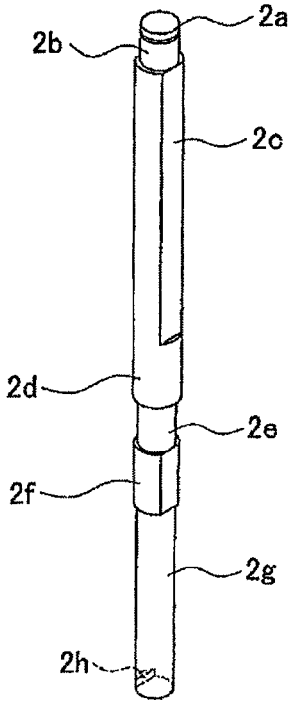
FIG. 16B is a perspective view of a main shaft of an automatic original cover operator according to the present invention.

Next, a main shaft 2 comprises, as shown in particular in FIGS. 16A and 16B, a first circular shaft portion 2*b* provided with a circumferential groove 2*a* on one end side, a first deformed shaft portion 2*c* provided in a continuous manner from the first circular shaft portion 2*b*, a second circular shaft portion 2*d* provided in a continuous manner from the first deformed shaft portion 2*c*, a third circular shaft portion 2*e* provided in a continuous manner from the second circular shaft portion 2*d*, a second deformed shaft portion 2*f* provided in a continuous manner from the third circular shaft portion 2*e*, a fourth circular shaft portion 2*g* provided in a continuous manner from the second deformed shaft portion 2*f*, a third deformed shaft portion 2*h* provided in a continuous manner from the fourth circular shaft portion 2*g*. The first circular shaft portion 2*b* as well as the third circular shaft portion 2*e* and the portions operator to a tip protrude outward from respective both side plates 1*b*, 1*b* of a mounting member 1, and part of the first circular shaft portion 2*b* and the second deformed shaft portion 2*f* is provided with a rotation controlling mechanism L as described below. Further, the second deformed shaft portion 2*f* and the portions operator to a tip reach to the inside of a drive case 25 of a driving part G. In the meantime, reference numeral 2*i* denotes a fixing ring. The main shaft 2 is, in particular as shown in FIGS. 6 and 13 and others, provided with a distortion detecting means 46. The embodiment, assembled as above described, enables one to detect a distortion accompanied by rotation of the main shaft 2, and to actuate a drive motor 26 in order to assist in opening and closing operation, in case that an original cover is manually opened and closed when the drive motor 26 stops.

Next, a supporting member 3 has a top plate 3*a* and both side plates 3*b*, 3*b* extending downward perpendicular to both sides of the top plate 3, and the both side plates 3*b*, 3*b* are provided on a rear side thereof with first coupling holes 3*c*, 3*c*, to which the main shaft 2 fixed into coupling holes 1*f*, 1*f* of a mounting member 1 is coupled. Further, the both side plates 3*b*, 3*b* are provided with second coupling holes 3*d*, 3*d* on their respective tip sides for rotatably mounting a lifting member 5 via a connecting shaft 4 on a supporting member 3.

Figure 17:
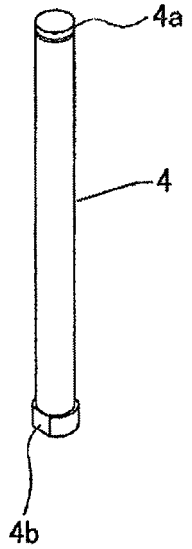
FIG. 17 is a perspective view of a connecting shaft of an automatic opening/closing device according to the present invention.
Figure 18:
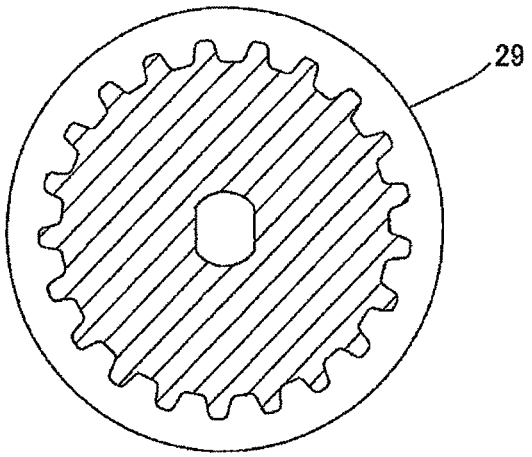
FIG. 18 is a vertical sectional view of a clutch pulley of a driving part of an automatic opening/closing device according to the present invention.

Next, a connecting shaft 4 is, as shown in particular in FIG. 17, shaped in round bar and has a circumferential groove 4*a* provided on one end portion and a deformed portion 4*b* provided on other end portion. Further, an E ring 4*c* is mounted on the circumferential groove 4*a* protruding from one of the both side plates 5*b*, 5*b* of the lifting member 5, and a case plate 25*a* is fixed to a portion protruding from other.

A lifting member 5 has a top plate 5*a*, both side plates 5*b*, 5*b* extending downward perpendicular to both sides of the top plate 5, and mounting plates 5*c*, 5*c* formed by folding outward at the bottom end portions of the both side plates 5*b*, 5*b*. The both side plates 5*b*, 5*b* are pivotally supported via a connecting shaft 4 on both side plates 3*b*, 3*b* of a supporting member 3, so as to be rotatable. The lifting member 5 is additionally provided with first coupling holes 5*d*, 5*d* for mounting the connecting shaft 4 at a vertical position toward the tip side and second coupling holes 5*e*, 5*e* for coupling to an actuating member 13 as described below. In the meantime, reference numerals 5*h*, 5*h* denote collars, while numerals 5*g*, 5*g* bearing members.

A height adjusting means I for adjusting height for mounting of an original cover C is further provided between a top plate 5*a* of a lifting member 5 and a top plate 3*a* of a supporting member 3. The height adjusting means I is an adjusting screw 10 mounted by screwing through on the top plate 5*a* of the lifting member 5. A tip of the adjusting screw 10 abuts against the top plate 3*a* of the supporting member 3 and rotation of the adjusting screw 10 causes a slight rotation of the lifting member 5 in a vertical direction with a supporting point at a connecting shaft 4, which then enables to adjust the height of the original cover C mounted on mounting plates 5*c*, 5*c* of the lifting member 5. A clamping nut may be additionally coupled to the adjusting screw 10.

Figure 8:
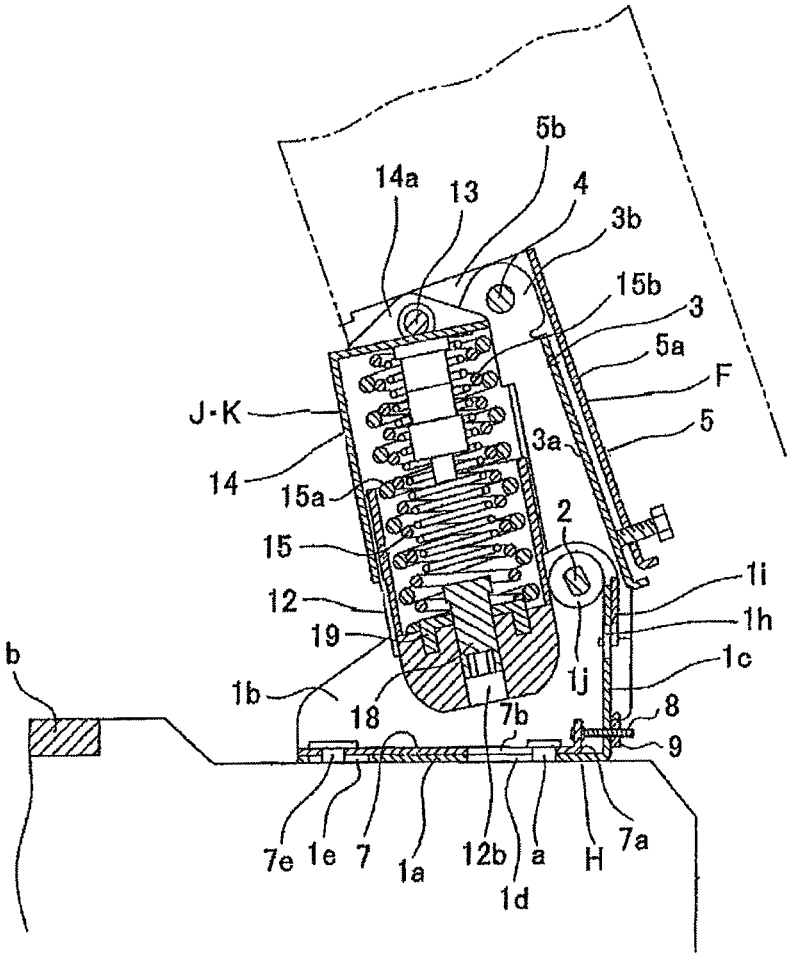
FIG. 8 is a sectional view showing operation of an area of a hinge part of an automatic opening/closing device according to the present invention.

A first means for controlling rotation J provided by rotatably urging a lifting member 5 toward a supporting member 3 for controlling an inverse rotation of the lifting member 5 comprises, as shown in particular in FIGS. 6 and 8, a first spring receiving member 12 in a hollow-case shape made e.g. of synthetic resin and formed by swingably engaging engagement grooves 12*a*, 12*a* (of which only one is shown) provided on lower end portions thereof with locking pins 11, 11 coupled to locking holes 1*g*, 1*g* provided on both side plates 1*b*, 1*b* of a mounting member 1, a second spring receiving member 14 in a case-like shape coupled to second coupling holes 5*e*, 5*e* of the lifting member 5 and formed by slidably accommodating the first spring receiving member 12 into the interior thereof, in which an actuating member 13 e.g. in a pin-like shape is swingably coupled to coupling holes 14*b*, 14*b* provided on a top of both side plates 14*a*, 14*a* thereof, and a compression spring 15 consisting of large and small compression springs, e.g. a first compression spring 15*a* and a second compression spring 15*b* which are accommodated and resiliently provided in the first spring receiving member 12 and the second spring receiving member 14, respectively. In the meantime, long grooves 14*c*, 14*c* (of which only one is shown) provided on the lower end portions of the both side plates 14*a*, 14*a* of the second spring receiving member 14 are escape grooves of locking pins 11, 11.

In the meantime, a layout of a first means for controlling rotation J as above described is not limited to the one described in embodiment 1. For example, a layout is also possible wherein a torsion coil spring is wound round a connecting shaft 4 assembled with the first means for controlling rotation J as above described or being an independent assembly without it, and one end portion of the connecting shaft 4 is locked on a side of a supporting member 3 while the other end portion on the side of a lifting member 5, so that the lifting member 5 is rotatably urged toward a direction in which it overlaps the supporting member 3. In this case, a compression spring 15 can be designed as above described, but also resiliently provided toward a top plate provided on a free end side of the supporting member 3. Moreover, the first means for controlling rotation J can be omitted in a layout of a mounting member 1 in a one-leg shape into a mounting hole (not shown) provided on the main body B so as to be vertically movable with regard to it, since in this case the lifting member 5 itself is not necessary. Additionally, an actuating member 13 is not necessarily formed in a pin-like shape, but can be an element not in a pin-like shape mounted on the side of the lifting member 5.

Figure 9:
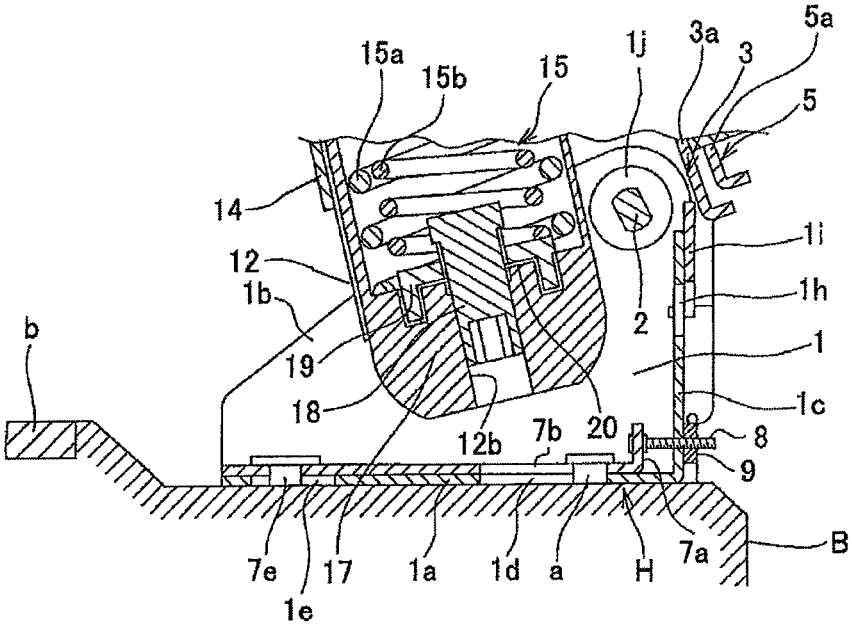
FIG. 9 is an enlarged sectional view of an area of a resilient force adjusting means of a hinge part of an automatic opening/closing device according to the present invention.
Figure 10:
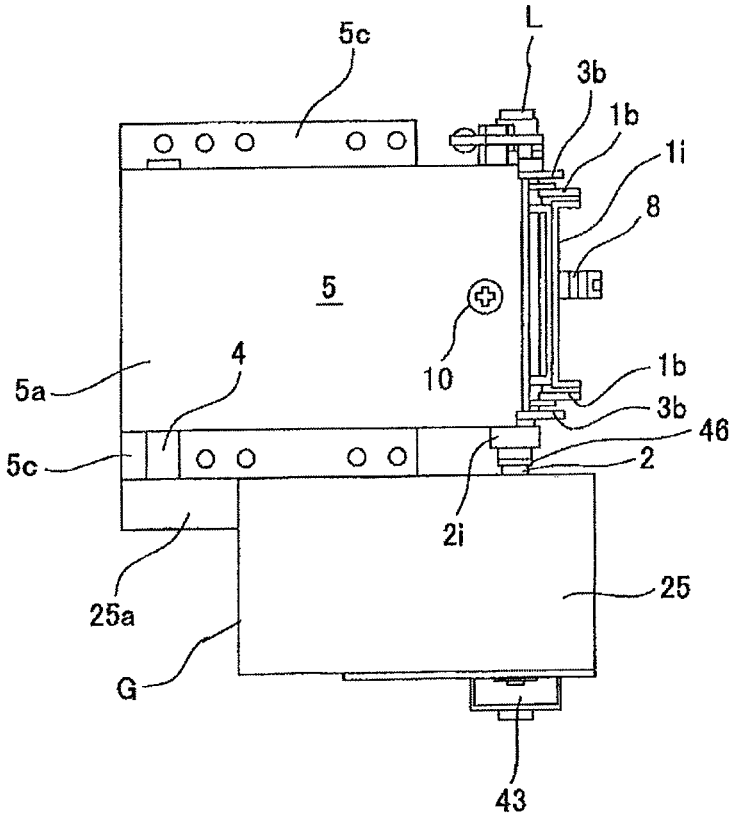
FIG. 10 is a plan view of an automatic opening/closing device according to the present invention.
Figure 11:
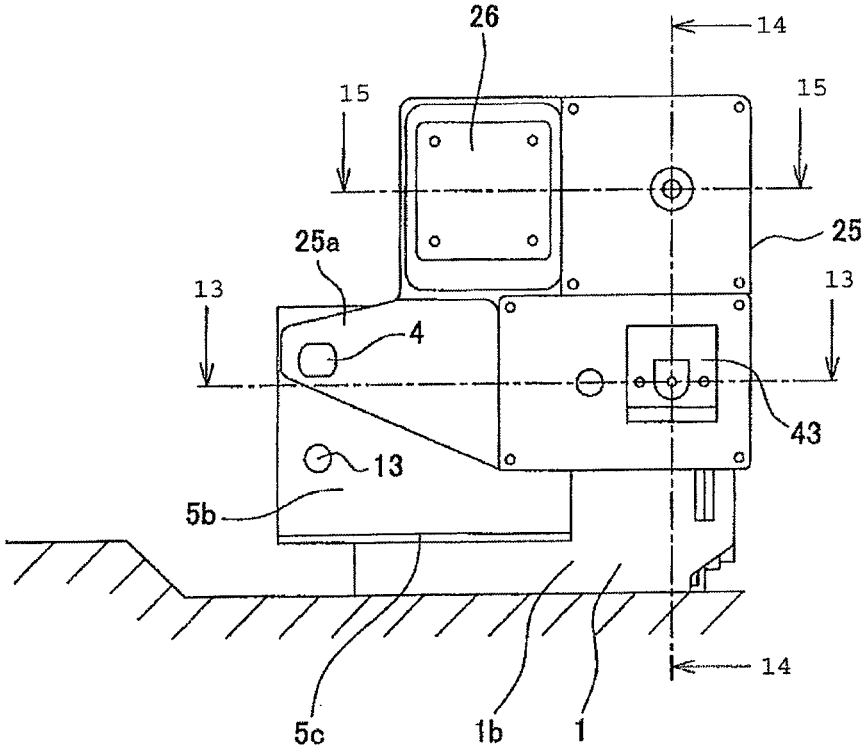
FIG. 11 is a right side view of an automatic opening/closing device according to the present invention.
Figure 12:
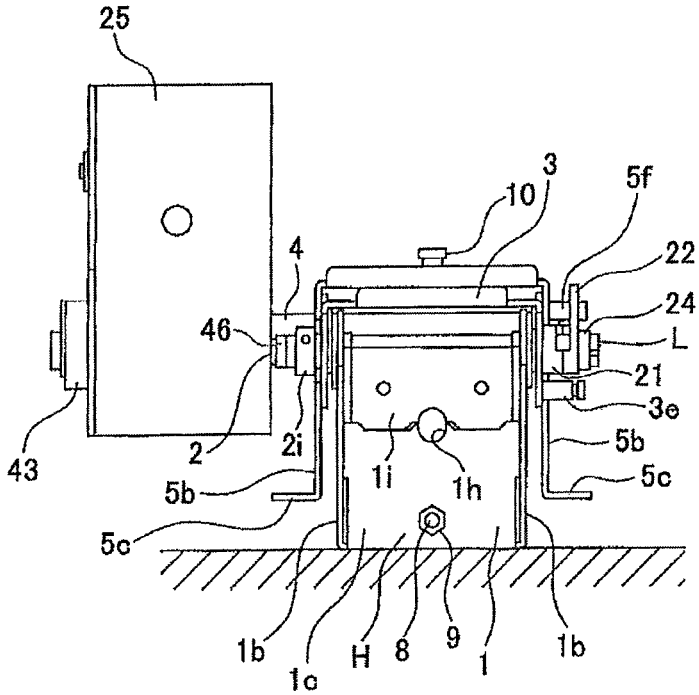
FIG. 12 is a rear view of an automatic opening/closing device according to the present invention.

Next, a second means for controlling rotation K has a common layout with a first means for controlling rotation J, and it suffices, as shown in particular in FIGS. 6 and 9, to comprise a first spring receiving member 12 in a hollow-case shape made e.g. of synthetic resin and formed by swingably engaging engagement grooves 12*a*, 12*a* (of which only one is shown) provided on lower end portions thereof with locking pins 11, 11 coupled to locking holes 1*g*, 1*g* provided on both side plates 1*b*, 1*b* of a mounting member 1, a second spring receiving member 14 mounted on second coupling holes 5*e*, 5*e* of a lifting member 5, in which an actuating member 13 e.g. in a pin-like shape is swingably coupled to coupling holes 14*b*, 14*b* provided on a top of both side plates 14*a*, 14*a* thereof, and a compression spring 15 consisting of large and small compression springs, e.g. a first compression spring 15*a* and a second compression spring 15*b* which are accommodated and resiliently provided in the first spring receiving member 12 and a second spring receiving member 14, respectively.

However, embodiment 1 is so designed, in particular consideration of a heavy weight of an original cover C, that a second means for controlling rotation K as above described is further equipped with a fluid damper device 16 and a resilient force adjusting means 17 of a compression spring 15. Further, a second spring receiving member 14 can also be designed in a rectangular tube shape so that it accommodates a first spring receiving member 12 in the interior thereof, in order to achieve a damper action using mutual fitting state.

A fluid damper device 16 has a piston rod 16*a* and is therefore of publicly known layout. A resilient force adjusting means 17 comprises an adjusting screw 18 rotatably coupled to an adjusting hole 12*b* provided on an inner bottom portion of a first spring receiving member 12, an adjusting plate 19 fixed by screwing to the adjusting screw 18 and a positioning plate 20 for positioning the adjusting screw 18.

In the meantime, a fluid damper device 16 and a resilient force adjusting means 17 are, although the object of the present invention can be achieved even without them as above stated, desirable components in a heavy original cover weighing some 20-30 kg. Further, a layout of a second means for controlling rotation K is not limited to that in an embodiment as above described, but may be substituted e.g. with a publicly known layout, wherein a cam member is provided on the side of a mounting member, a slider is provided on the side of a supporting member with the tip thereof abutting against the cam member, and a compression spring is so provided that the slider can be contacted under pressure toward the supporting member.

Figure 19:
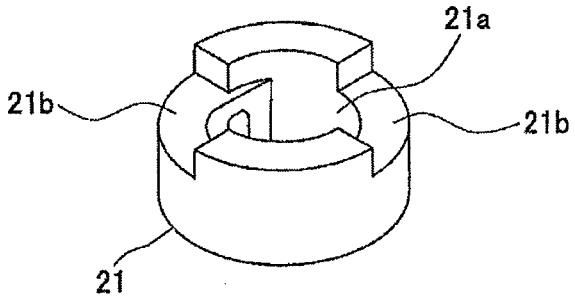
FIG. 19 is a perspective view of a first locking member of a rotation controlling mechanism of a lifting member of an automatic opening/closing device according to the present invention.
Figure 20A:
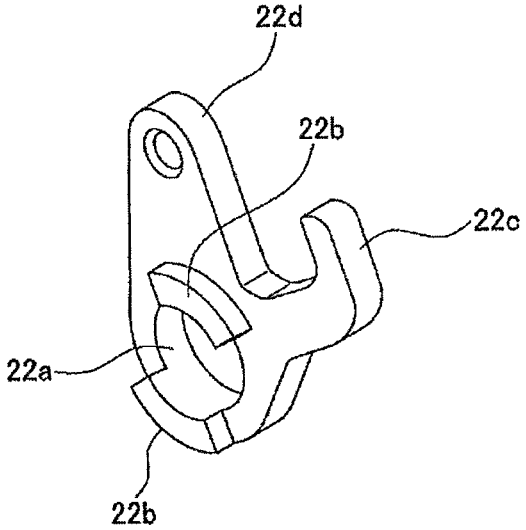
FIG. 20A is a perspective view of a second locking member of a rotation controlling mechanism of a lifting member of an automatic original cover operator according to the present invention, as viewed from one side.
Figure 20B:
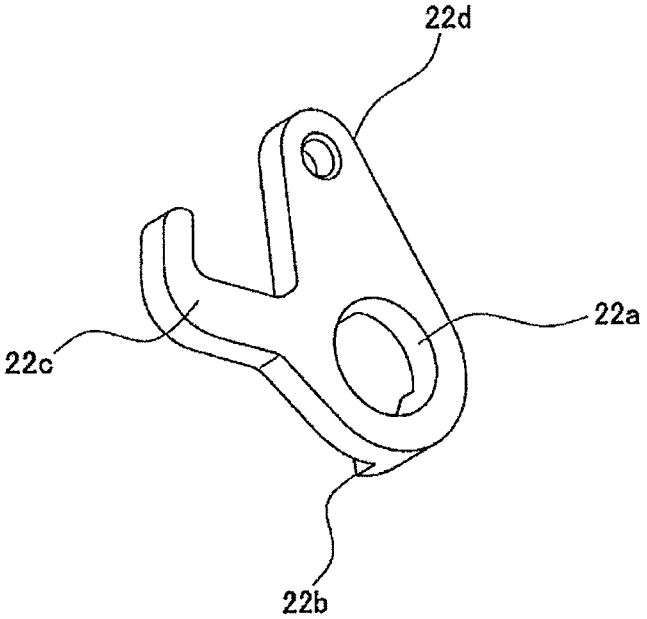
FIG. 20B is a perspective view of a second locking member of a rotation controlling mechanism of a lifting member of an automatic original cover operator according to the present invention, as viewed from one side.

Next, a rotation controlling mechanism L comprises, as shown in particular in FIG. 19, a first locking member 21 in a cylindrical shape having a pair of engagement recess portions 21*b*, 21*b* on one side portion and restricted in rotation by attaching and fixing a first deformed shaft portion 2*c* of a main shaft 2 to a deformed mounting hole 21*a*, a second locking member 22 having an insertion hole 22*a*, a pair of engagement convex portions 22*b*, 22*b* provided around the insertion hole 22*a* and an engagement portion 22*c* and a locking portion 22*d*, both provided respectively in a vertical direction, wherein the engagement convex portions 22*b*, 22*b* are formed by rotatably inserting a first circular shaft portion 2*b* of a main shaft 2 into the insertion hole 22*a*, a locking pin 5*f* engaged with the engagement portion 22*c* of the second locking member 22 and mounted on a side plate 5*b* of a lifting member 5 and e.g. a tension coil spring 23 stretchingly provided by locking one end portion at the locking portion 22*d* of the second locking member 22 and other end portion at a locking pin 3*e* mounted on a side plate 3*b* of a supporting member 3. In the meantime, reference numeral 24 denotes a fixing ring for preventing escape. Then, the engagement recess portions 21*b*, 21*b* of the first locking member 21 and the engagement convex portions 22*b*, 22*b* of the second locking member 22 engage each other, and a small gap g is provided between the engagement recess portions 21*b*, 21*b* and the engagement convex portions 22*b*, 22*b*.

Next, a layout of a driving part G is described. The driving part G comprises a drive case 25 mounted on a main shaft 2 and a connecting shaft 4, a drive motor 26 as a power source such as a stepping motor mounted in the inside of the drive case 25, a first endless belt 27*a* such as a timing belt for transmitting rotation drive force of a rotation pulley 27 mounted on a rotation axis 26*a* of the drive motor 26 to e.g. a clutch pulley 29 of an electromagnetic clutch means 28, a reduction mechanism M for transmitting rotation drive force from a rotation axis 30 of an electromagnetic clutch means 28 to the main shaft 2.

A reduction mechanism M as above described comprises a first reduction pulley 31 mounted on a rotation axis 30 of a clutch pulley 29 of an electromagnetic clutch means 28, a second reduction pulley 33 for transmitting rotation drive force of the first reduction pulley 31 via a second endless belt 32 such as timing belt, a first gear 34, a second gear 35, a third gear 36, a fourth gear 37, a fifth gear 38, a sixth gear 39 and a seventh gear 40, these gears transmitting rotation drive force of the second reduction pulley 33 to a main shaft 2, and a drive gear 41; the drive gear 41 is fixed on the main shaft 2. Then, a tip of a case plate 25*a* of a drive case 25 on the side of a hinge part F is coupled and fixed to a connecting shaft 4.

Namely, a second reduction pulley 33, a first gear 34, a fourth gear 37 and a fifth gear 38 are pivotally supported on a main shaft 2 so as to rotate with regard to it. A second gear 35, a third gear 36, a sixth gear 39 and a seventh gear 40 are pivotally supported on a gear support shaft 42 so as to rotate with regard to it. A rotation angle sensor 43 of the main shaft 2 and a supporting member 3 is mounted on a tip of the main shaft 2.

An original cover C is mounted via mounting pieces c, c on mounting plates 5*c*, 5*c* of a lifting member 5. A drive case 25 is mounted on a main shaft 2 and a connecting shaft 4, and not mounted as such on the original cover C. In the meantime, other embodiment can be also conceived in this regard, in layouts without a supporting member 3 of a hinge part F or without a lifting member 5, wherein a drive case 25 is directly mounted on the original cover C.

Moreover, a layout of a driving part G is not limited to an embodiment as above described. The driving part G suffices to comprise at least a drive motor 26 and a reduction mechanism M, but is advantageous in that operability and function are improved, if it is equipped at least with an electromagnetic clutch means 28 or other clutch means and a rotation angle sensor 43. Further, a layout using two or more endless belts will be advantageous in that it can effectively prevent backlash from occurring.

In the following, an operation of the automatic opening/closing device E according to embodiment 1 is described.

Figure 21A:
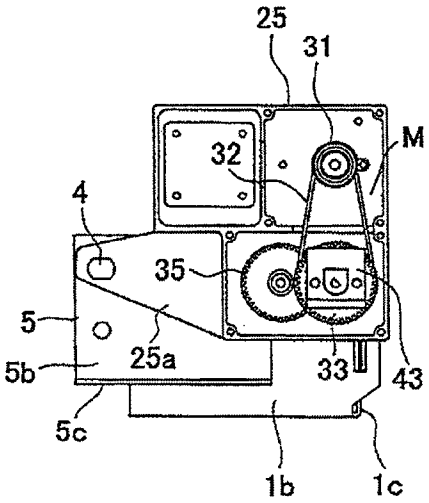
FIG. 21A, FIG. 21B, and FIG. 21C illustrate an automatic original cover operator according to the present invention in various states relative to starting operation and the end of operation, shown without a case cover on the right hand side of a drive case.
Figure 21B:
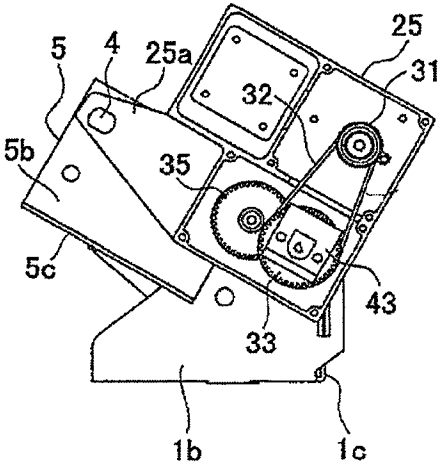
Figure 21C:
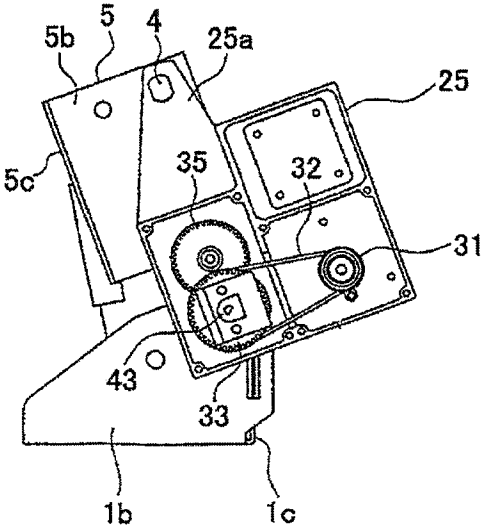

First, as shown in FIG. 21A, the drive motor 26 of the driving part G stops, when the original cover C is closed. As shown in particular in FIG. 7, the tip of the piston rod 16*a* of the fluid damper device 16 of a hinge part F abuts against the head portion of the adjusting screw 18. Then, in the closed state of the original cover C, the resilient force of the compression spring 15 is weaker than the weight of the original cover C, thus the original cover C stably keeps the position thereof in the closed state. In the meantime, it is also possible in this regard that the closed state is stably kept by setting the operation direction of the compression spring 15 downward.

When the opening/closing switch 44 for opening provided on the side of the main body B so as to open the original cover C is pressed in the closed state, the drive motor 26 is turned on and the rotation drive force thereof is transmitted via the reduction mechanism M to the drive gear 41.

Since the drive gear 41 is fixed on the main shaft 2, the drive case 25 is rotated to the opening direction of the original cover C. At this point, the supporting member 3 is rotated together with the drive case 25 with a supporting point at the main shaft 2 to open the original cover C, since the drive case 25 is coupled via the connecting shaft 4 to the supporting member 3.

When the original cover C is opened at the predetermined opening angle (about 70° in the embodiment), the rotation angle sensor 43 detects the opening angle to turn off the drive motor 26, so that the original cover C stops at the angle. When the original to be copied is set on the platen glass b on the side of the main body B and the switch 45 for closing is pressed, the drive motor 26 is rotated in a direction contrary to the above mentioned, so that the original cover C is closed. At this point, the closing angle of the original cover C is detected by the rotation angle sensor 43, and when the drive motor 26 stops at a closing angle of 15°, the original cover C is closed by the own weight thereof even with the drive motor 26 stopping, since the weight of the original cover C exceeds the resilient force of the compression spring 15. Then, the embodiment prevents the main body B from receiving impact or pinching the hand, by allowing the tip of the piston rod 16*a* of the fluid damper device 16 to abut against the head portion of the adjusting screw 18 at a closing angle about 5° and then to assume a damper action, so as to avoid a sudden drop of the original cover C. In the meantime, the maximum opening angle of the original cover C is about 90°+/−5°, while an angle at which the original cover C start closing by the own weight thereof is about 15°+/−5° in practice. Since the hinge part F is provided with the second means for controlling rotation K, an angle at which the original cover C assumes the free stop state is about 60 °+/−5° from the angle at which the original cover C falls by the own weight thereof. In the meantime, a friction mechanism using friction washers for which illustration and description are omitted can be additionally provided, in order to achieve free stop function of the original cover C.

In the meantime, the opening operation of the original cover C from the closed state can be also manually conducted without using the drive motor 26. In this case, when the fore side of the original cover C is lifted upwards by hands, the original cover C is rotated together with the supporting member 3 with a supporting point at the main shaft 2 to allow for opening. In this case, the rotation drive force of the main shaft 2 is not transmitted by the electromagnetic clutch means 28 to the drive motor 26. However, a layout is practicable, wherein a rotation of the original cover C during a manual opening/closing operation is detected by the rotation angle sensor 43 to turn on the drive motor 26.

Moreover, a layout is also possible in this regard, wherein distortion of the main shaft 2 accompanied by a manual opening operation of the original cover C is detected by the distortion detecting means 46, to turn on the drive motor 26 and to assist in the manual opening operation. Further, the distortion detecting means 46 can be also mounted on the side of the connecting shaft 4.

Still further, the original cover C in the opened state can be also manually closed. In this case, when hands are placed on the original cover C on the side thereof close to the operator, the original cover C is closed via the supporting member 3 with a supporting point at the main shaft 2. At this point, the rotation drive force to be transmitted via the main shaft 2 and the reduction mechanism M to the drive motor 26 is cancelled by the electromagnetic clutch means 28 and not transmitted to the drive motor 26.

However, an arrangement is also possible, wherein rotation of the main shaft 2 accompanied by a manual opening operation of the original cover C is detected by the rotation angle sensor 43 and the distortion detecting means 46, to rotate the drive motor 26 in an inverse direction, so that the original cover C is automatically closed. In this case also, the drive motor 26 is turned off at the predetermined opening angle, the original cover C is closed by the own weight and the fluid damper 16 and other damper means not shown operate at the predetermined opening angle.

The hinge part F according to the present embodiment 1 comprises the second means for controlling rotation K, so that the original cover C can be opened in opening the original cover C, with the original weight of the original cover C being reduced, while it can be closed without suddenly dropping by the weight thereof in closing it.

The means for controlling rotation J rotatably urges the lifting member 5 to a direction in which it overlaps the supporting member 3, and when the voluminous original such as book is set on the platen glass b of the original cover C once manually or automatically opened and the original cover C is closed, for the means for controlling rotation J according to the present embodiment 1, the original cover C abuts against the end portion of the voluminous original, so that the lifting member 5 is inversely rotated with a supporting point at the connecting shaft 4. In this manner, the original cover C flatly covers the top surface of the voluminous original, and the means for controlling rotation J can prevent outside light from reaching to the interior of the main body B as much as possible.

The rotation controlling mechanism L for said lifting member 5 prevents a so-called "center crease" phenomenon, wherein the lifting member 5 is rotated with a supporting point at the connecting shaft 4 even with the means for controllong rotation J which cannot by itself bear the rotation torque then generated due to a large opening/closing device D mounted on the right of the main body B, when the opened original cover C is closed together with the supporting member 3, in particular for the heavy original cover C. Then, in the present invention, the locking pin 5*f* mounted on one of the both side plates 5*b*, 5*b* of the lifting member 5 is locked by the second locking member 22 of the rotation controlling mechanism L via the engagement portion 22*c* thereof, and even the heavy original cover C is inversely rotated at a normal closing operation so that a so-called "center crease" phenomenon is eliminated.

In the meantime, the gap g is provided since a "center crease" phenomenon of the lifting member 5 as above described frequently occurs when the original cover C once opened is closed using the driving part G. The gap g prevents the engagement recess portions 21*b*, 21*b* of the first locking member 21 and the engagement convex portions 22*b*, 22*b* of the second locking member 22 from engaging although the first locking member 21 is rotated via the main shaft 2 rotated together with the original cover C in opening, so that the second locking member 22 still locks the locking pin 5*f*. When the original cover C is opened at the predetermined opening angle, i.e. at the angle at which the voluminous original is accepted, the second locking member 22 is rotated so as to release the locking pin 5*f* from an engagement by the engagement portion 22*c*. In short, the rotation controlling mechanism L restricts the inverse rotation within the predetermined range of opening/closing angle.

In the meantime, the embodiment can be so designed that locking of the second locking member 22 and the locking pin 5*f* is released by the rotation torque then generated, when the voluminous original is set on the platen glass b and the original cover is pressed hard on the side close to the operator toward the closing direction, so that the inverse rotation of the original cover C is allowed.

At this point, the original cover C according to the present invention is inversely rotated against the rotation restriction force of both the means for controlling rotation J and the rotation controlling mechanism L.

In the meantime, either one of the means for controlling rotation J and t h e rotation controlling mechanism L may suffice as in the conventional devices, depending on the layout of the hinge part F.

EMBODIMENT 2

FIGS. 22 to 34 show other embodiment according to the present invention. According to the drawings, an automatic opening/closing device N according to this embodiment 2 is remarkably distinct from an automatic opening/closing device E according to embodiment 1 in that an operating point of a driving part lies on a connecting shaft 4 on a free end side of a supporting member 3 on which a drive case 25 is mounted in embodiment 1, while it lies on a side of a connecting shaft 52 rotatably mounted on a mounting member 50 on a base end side of a supporting member 51 in this embodiment 2.

A layout of a hinge part P is substantially the same as that of a hinge part F in embodiment 1, but differs from the latter in that a main shaft 2 in embodiment 1 is a connecting shaft 52 and a connecting shaft 4 in embodiment 1 is a main shaft 53.

Figure 31:
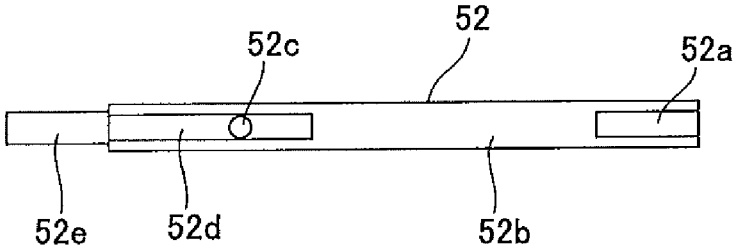
FIG. 31 is an elevation view of a connecting shaft of an automatic opening/closing device according to the present invention.

Namely, a connecting shaft 52 in this embodiment 2 comprises, as shown in particular in FIG. 31, a first deformed shaft portion 52*a*, a large diameter shaft portion 52*b*, a second deformed shaft portion 52*d* having a mounting hole 52*c* and a small diameter shaft portion 52*e*, as seen in sequence from one end portion.

A connecting shaft 52 as above described couples at the same time both side plates 51*b*, 51*b* formed by folding a top plate 51*a* of a supporting member 51 to both side plates 50*b*, 50*b* formed by folding a bottom plate 50*a* of a mounting member 50, and is so designed that it rotates, accompanied by the own rotation, the supporting member 51 by engaging a first deformed shaft portion 52*a* and a second deformed shaft portion 52*d* thereof with deformed mounting holes (not shown) of the both side plates 51*b*, 51*b* of the supporting member 51.

In a connecting shaft 52 as above described, an area of a large diameter shaft portion 52*b* is rotatably coupled to circular coupling holes (not shown) of both side plates 50*b*, 50*b* of a mounting member 50, one end portion protrudes outward from one side plate 51*b* of a supporting member 51 and a first deformed shaft portion 52*a* is equipped with a rotation controlling mechanism R of a lifting member 54. A second deformed shaft portion 52*d* and a portion operator to a tip of the connecting shaft 52 protrude outward from other side plate 51*b* of the supporting member 51, and a drive pulley 59 of a driving part Q as described below is fixed on the second deformed shaft portion 52*d* via a mounting screw 59*a* passing through a mounting hole 52*c*, so as to rotate together with the connecting shaft 52. Moreover, a small diameter shaft portion 52*e* of a connecting shaft 52 is pivotally supported on a pivotally supporting hole (not shown) of a case cover 55*a* of a drive case 55, and a fixing ring 60 for preventing escape is mounted on the tip thereof.

Figure 32A:
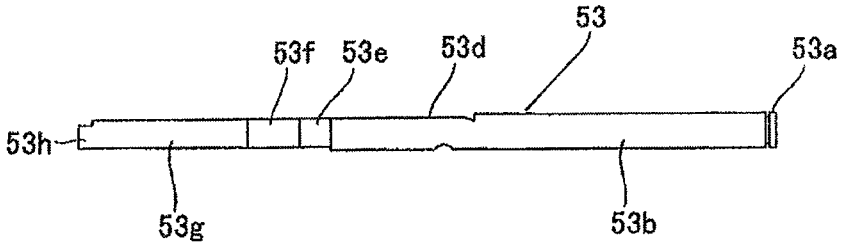
FIG. 32A is an elevation view of a main shaft of an automatic original cover operator according to the present invention.
Figure 32B:
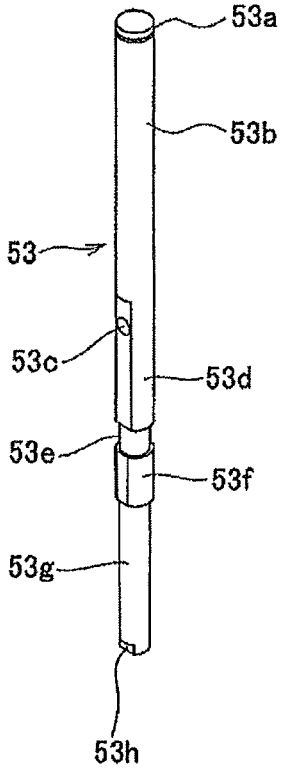
FIG. 32B a perspective view of a main shaft of an automatic original cover operator according to the present invention.
Figure 33A:
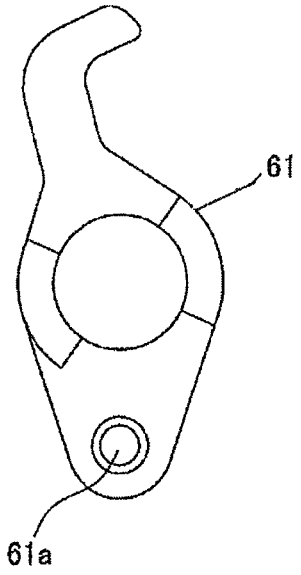
FIG. 33A is a side view of a second locking member of a means for controlling rotation of a lifting member of an automatic original cover operator according to the present invention.
Figure 33B:
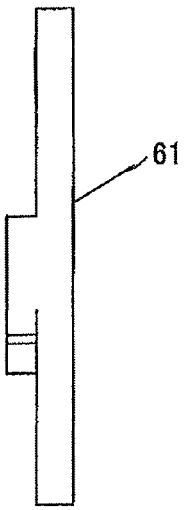
FIG. 33B an elevation view of a lifting member of an automatic original cover operator according to the present invention.
Figure 34A:
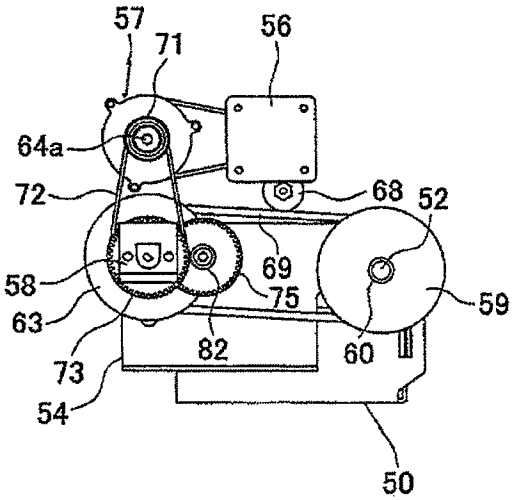
FIG. 34A shows an automatic original cover operator according to the present invention in a state in the midst of operation as shown without a drive case.
Figure 34B:
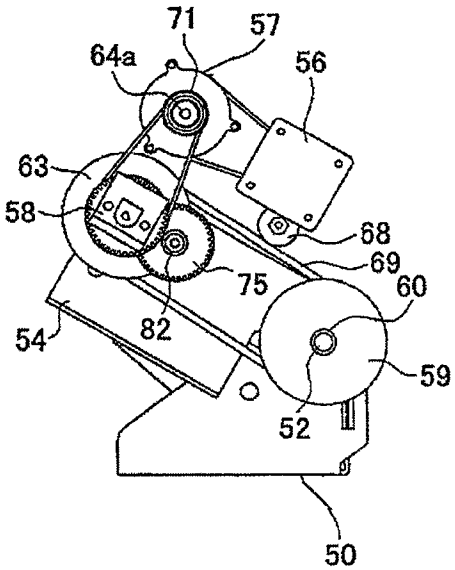
FIG. 34B shows an automatic original cover operator according to the present invention in a state in the midst of operation as shown without a drive case.
Figure 34C:
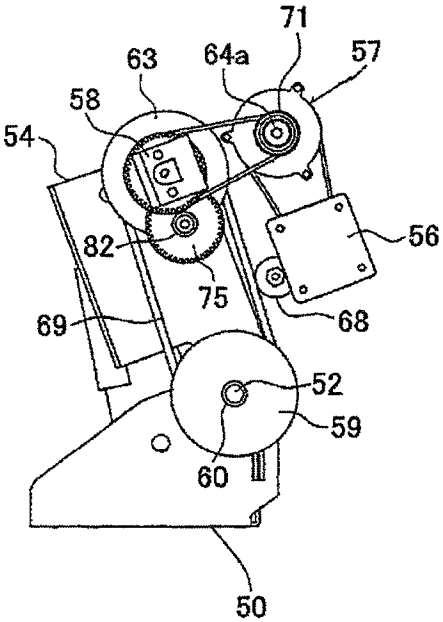
FIG. 34C shows an automatic original cover operator according to the present invention in a state in at the end of operation as shown without a drive case.

A main shaft 53 comprises, as shown in particular in FIGS. 32A and 32B, a circumferential groove 53*a* provided on one end portion thereof, a first circular shaft portion 53*b* provided in a continuous manner from the circumferential groove 53*a*, a first deformed shaft portion 53*d* having a mounting hole 53*c* provided in a continuous manner from the first circular shaft portion 53*b*, a second circular shaft portion 53*e* provided in a continuous manner from the first deformed shaft portion 53*d*, a second deformed shaft portion 53*f* provided in a continuous manner from the second circular shaft portion 53*e*, a third circular shaft portion 53*g* provided in a continuous manner from the second deformed shaft portion 53*f* and a third deformed shaft portion 53*h* provided in a continuous manner from the third circular shaft portion 53*g*.

Figure 27:
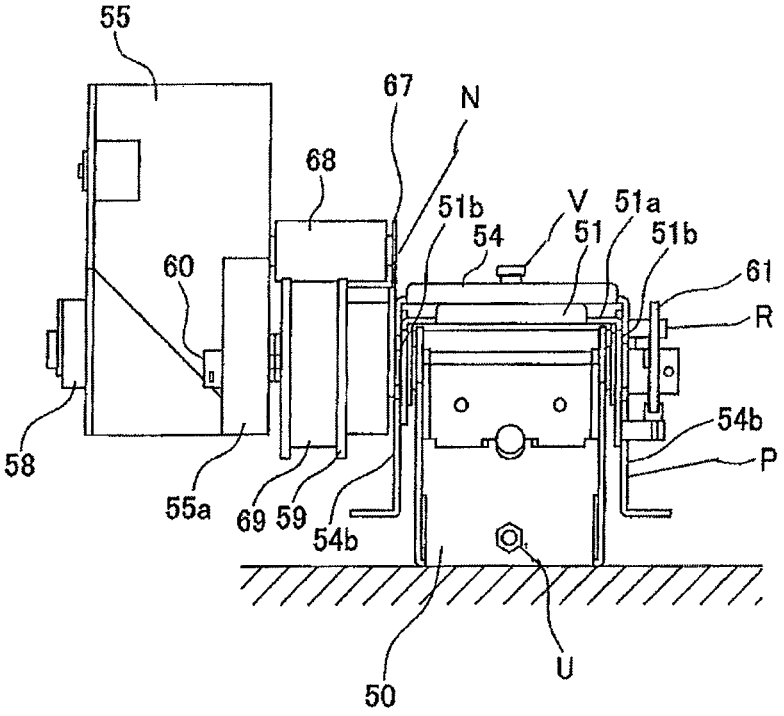
FIG. 27 is a rear view of an automatic opening/closing device according to the present invention.
Figure 28:
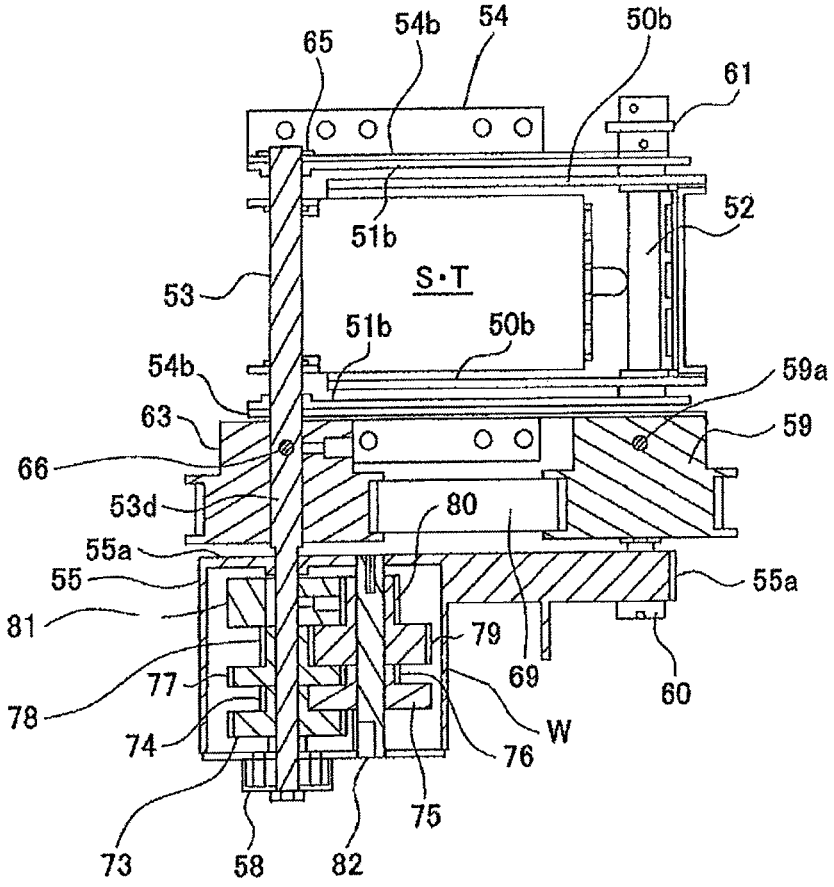
FIG. 28 is a sectional view of FIG. 26 in line 28-28.
Figure 29:
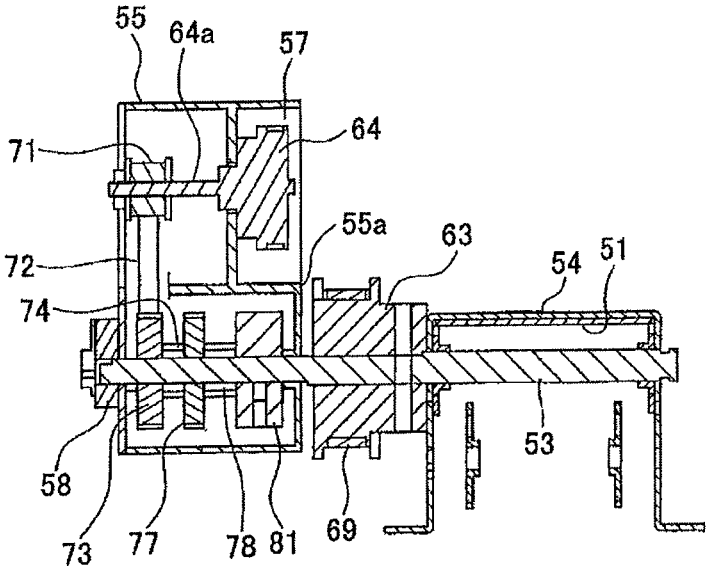
FIG. 29 is a sectional view of FIG. 26 in line 29-29.
Figure 30:
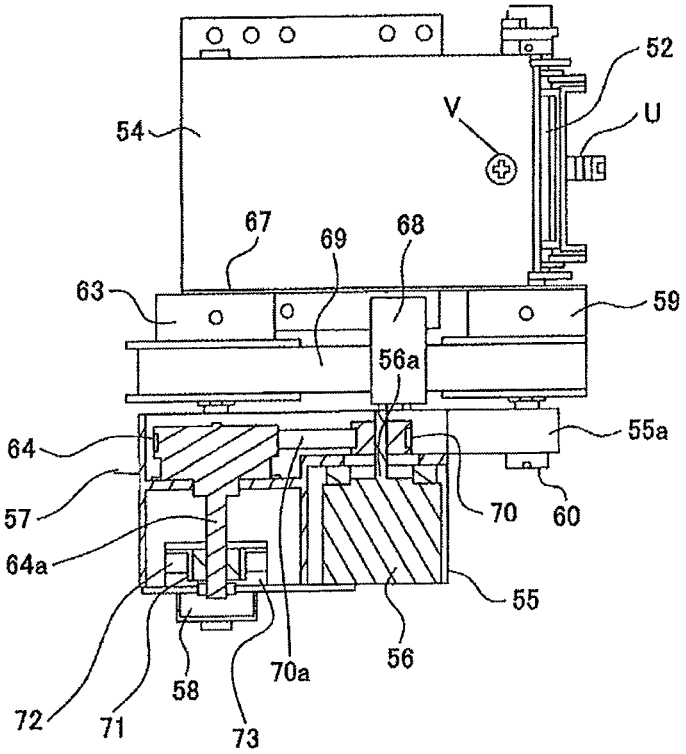
FIG. 30 is a sectional view of FIG. 26 in line 30-30.

An area of a first circular shaft portion 53*b* of a main shaft 53 is, as shown in particular in FIGS. 27 and 28, coupled to second coupling holes and first coupling holes (not shown) provided respectively on both side plates 51*b*, 51*b* of a supporting member 51 and both side plates 54*b*, 54*b* extending downward perpendicular to a top plate 54*a* of a lifting member 54. Then, an E ring 65 for preventing escape is fitted on an area of a circumferential groove 53*a* of the main shaft 53 protruding from one side plate 54*b* of the lifting member 54, as shown in particular in FIG. 25. A main pulley 63 of a driving part Q is, as shown in particular in FIG. 28, fixed via a mounting screw 66 passing through a mounting hole 53*c* on a first deformed shaft portion 53*d* being a protrusion of the main shaft 53 from other side plate 54*b* of the lifting member 54. Further, a second deformed shaft portion 53*f* and portions operator to a tip are inserted in the inside of the drive case 55.

In a rotation controlling mechanism R for said lifting member, a shape of a second locking means 61 is merely distinct from that of a second locking member 22 in embodiment 1, and the remaining layout is not subject to substantial changes. Namely, the second locking means 61 according to embodiment 2 uses, as shown in particular in FIGS. 24, 33A and 33B, a locking hole 61*a* for locking one end portion of a tension coil spring 62, instead of a locking portion 22*d* of the second locking member 22 in embodiment 1. The operation and effect thereof is not different from those of embodiment 1, thus the description is omitted.

The remaining components of a hinge part P are the same as those in embodiment 1, therefore the description is omitted in this regard. Further, layouts of a mounting position adjusting means U, a height adjusting means V, a first means for controlling rotation S and a second means for controlling rotation T provided on the hinge part P are the same as those in embodiment 1, therefore sufficient illustration and description are omitted in this regard.

Moreover, layout of a hinge part P is not limited to that in this embodiment 2 as described above and shown in this regard, in the same manner as described above with regard to embodiment 1. In this regard, other hinge parts of publicly known layout or those not described herein can be used, unless there are obstacles for cooperation with the driving part.

A driving part Q according to this embodiment 2 is the same as that in embodiment 1, in that it comprises a drive case 55, a drive motor 56, an electromagnetic clutch means 57, a reduction mechanism W, a rotation angle sensor 58 and others, but their location and assembly are different in part. Explanation is made hereinafter.

A drive case 55 is mounted on a connecting shaft 52 and a main shaft 53 which pass through a case cover 55*a* of the drive case 55, and thus it is not directly mounted on an original cover C. And it is so designed that, when a drive pulley 59 rotates, the drive case 55 as a whole is rotated together with a supporting member 51 with a supporting point at the connecting shaft 52 provided on the side of the mounting member 50.

Figure 22:
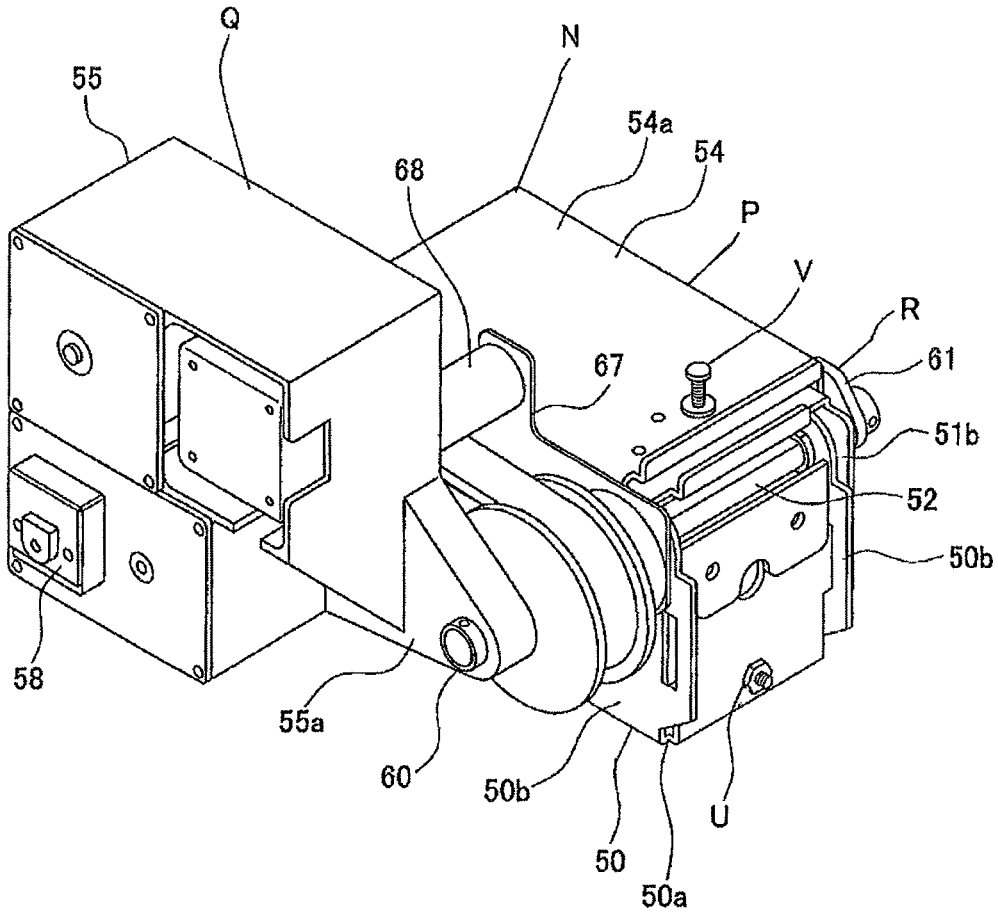
FIG. 22 is a perspective view showing other embodiment of an automatic opening/closing device according to the present invention.
Figure 23:
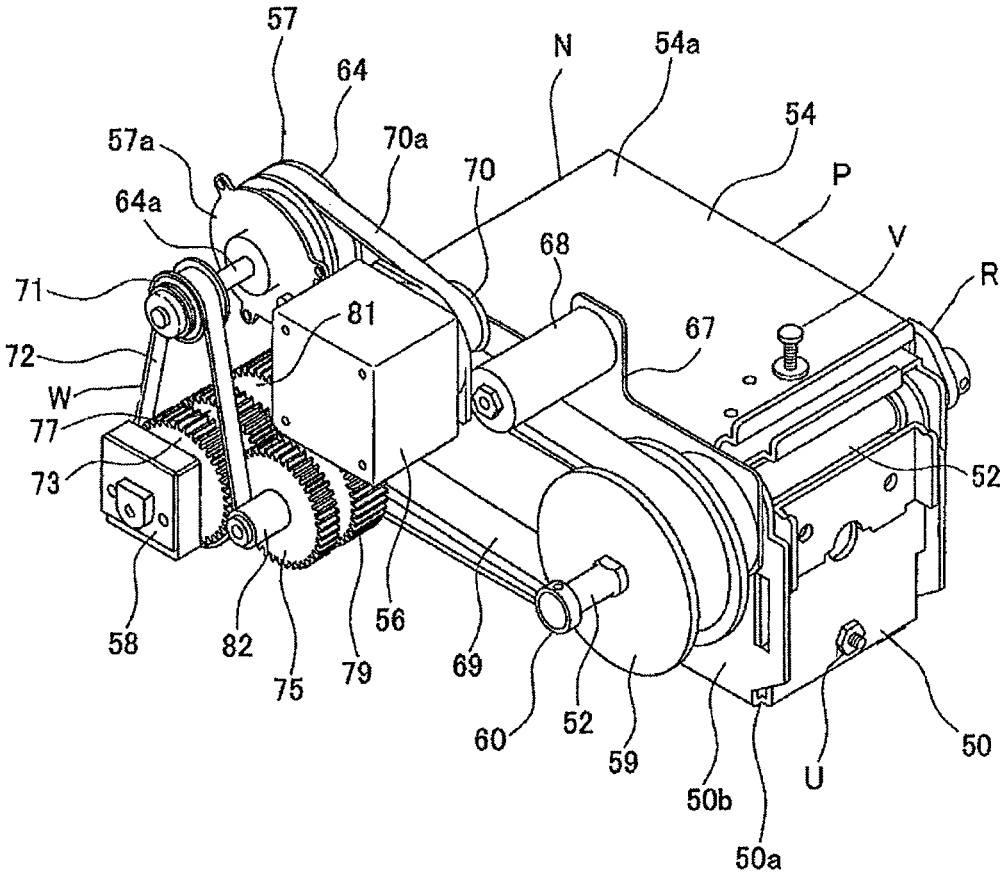
FIG. 23 is a perspective view of a state in FIG. 22, but shown without a driving part case of a driving part.

A driving part Q according to this embodiment 2 is, as shown in particular in FIGS. 22 and 23, provided with an electromagnetic clutch means 57 mounted via a mounting plate 57*a*, a reduction mechanism W, a rotation angle sensor 58 and others, all on the fore portion side of a drive case 55. It is thus different from that in embodiment 1, in that an electromagnetic clutch means 28, a reduction mechanism M, a rotation angle sensor 43 and others are not provided on the rear portion side of a drive case 25, and that a rotation drive force of a main pulley 63 is transmitted by rotation thereof to a drive pulley 59 mounted on a connecting shaft 52 via a third endless belt 69 such as a timing belt. Further, the layout is also different in that a mounting plate 67 as mounted on a connecting shaft 52 and a main shaft 53 is provided between one side plate 54*b* of a lifting member 54 and a drive case 55, wherein a tension roller 68 for applying a tension to a third endless belt 69 is mounted on a mounting plate 67.

Figure 24:
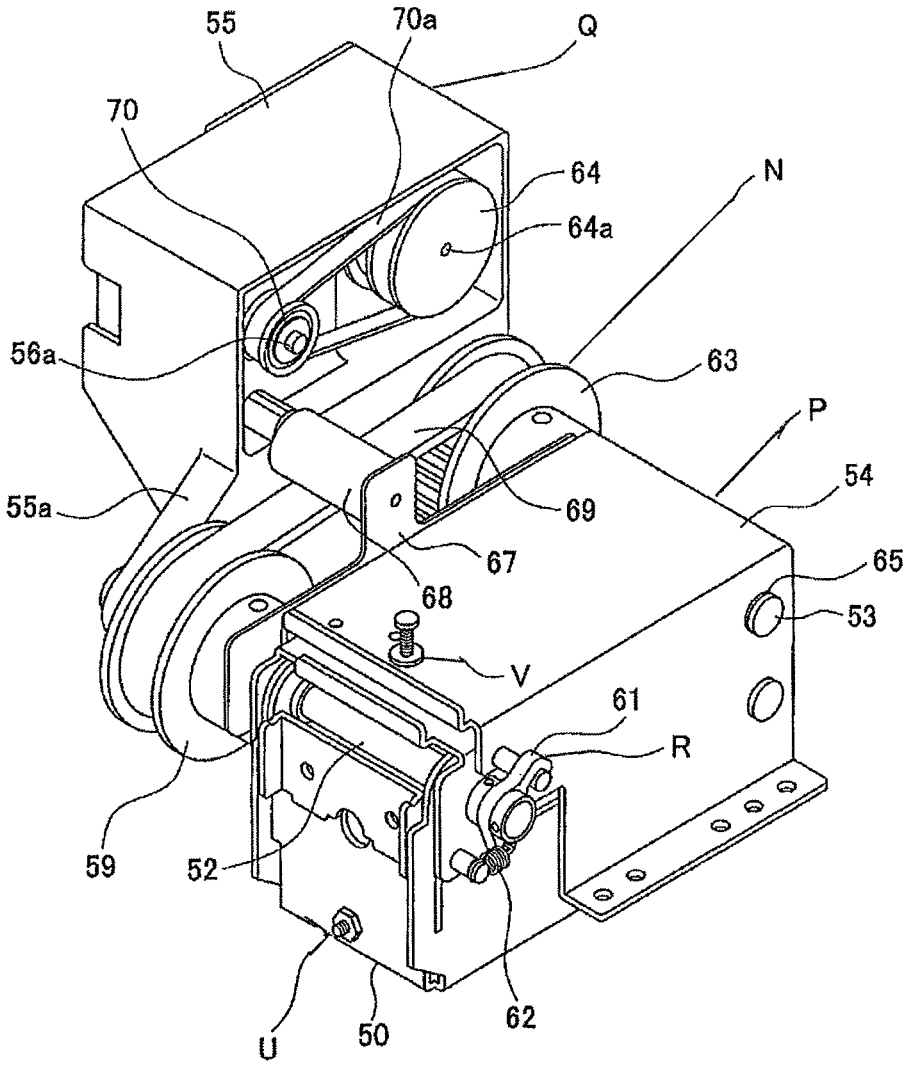
FIG. 24 is a perspective view showing an automatic opening/closing device according to the present invention from other side.
Figure 25:
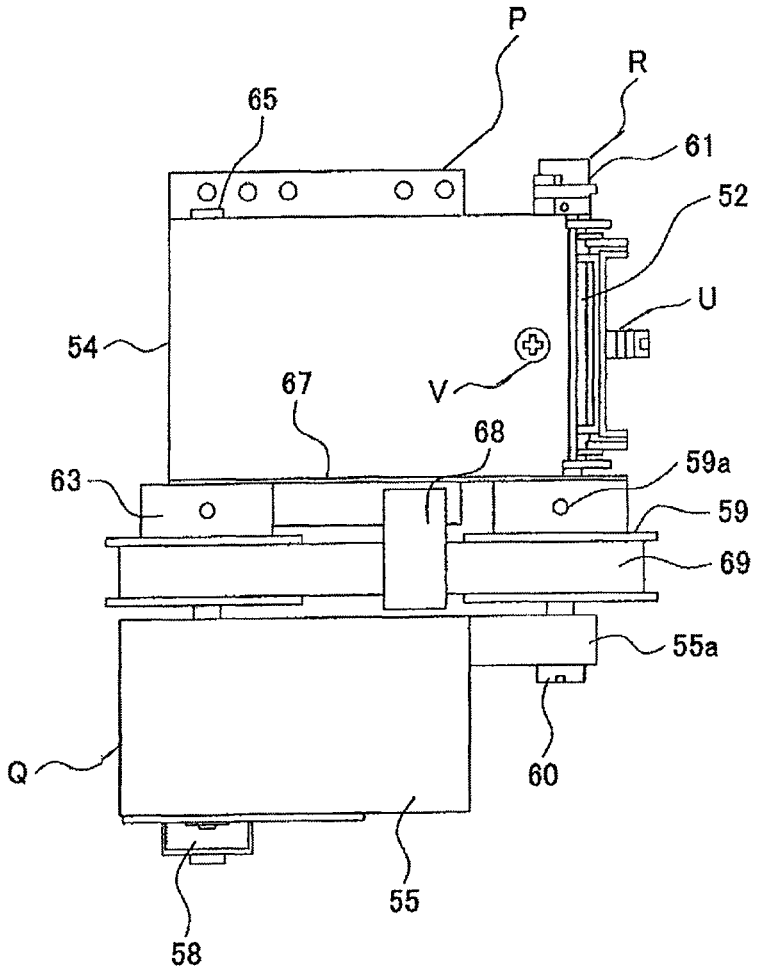
FIG. 25 is a plan view of an automatic opening/closing device according to the present invention.
Figure 26:
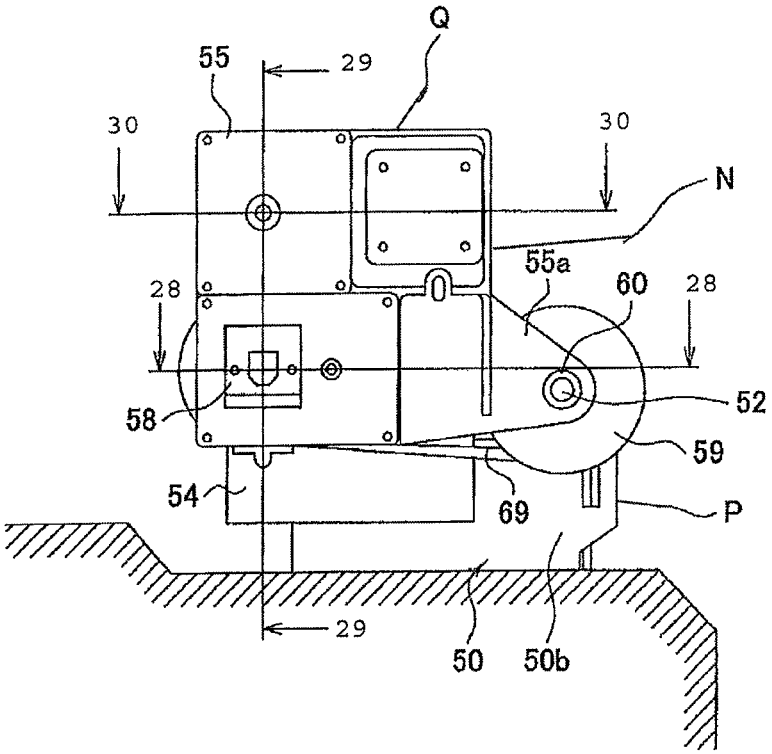
FIG. 26 is a right side view of an automatic opening/closing device according to the present invention.

A driving part Q according to this embodiment 2 is, as shown in particular in FIG. 24, so designed that a rotation drive force of a rotation pulley 70 mounted on a rotation axis 56*a* of a drive motor 56 is transmitted via a first endless belt 70*a* such as timing belt, as well as via an electromagnetic clutch means 57, a reduction mechanism W, a main pulley 63 and a drive pulley 59 to a connecting shaft 52, wherein the reduction mechanism W comprises a first reduction pulley 71 mounted on a rotation axis 64*a* of a clutch pulley 64 of the electromagnetic clutch means 57, a second reduction pulley 73 for transmitting a rotation drive force of the first reduction pulley 71 via a second endless belt 72 such as timing belt, a first gear 74, a second gear 75, a third gear 76, a fourth gear 77, a fifth gear 78, a sixth gear 79 and a seventh gear 80, these gears transmitting rotation drive force of the second reduction pulley 73 to a main shaft 52, as shown in FIG. 28, and a drive gear 81; the drive gear 81 is fixed on the main shaft 53. Namely, a second reduction pulley 73, a first gear 74, a fourth gear 77 and a fifth gear 78 are pivotally supported on a main shaft 53 so as to rotate with regard to it. A second gear 75, a third gear 76, a sixth gear 79 and a seventh gear 80 are pivotally supported on a gear support shaft 82 mounted on a drive case 55 so as to rotate with regard to it. A rotation angle sensor 58 of the main shaft 53 and a supporting member 51 is mounted on a third deformed shaft portion 53*h* of the main shaft 53 on the side of the drive case 55.

Therefore, rotation of a drive motor 56 travels from a rotation pulley 70 via a first endless belt 70*a* and a clutch pulley 64 of an electromagnetic clutch means 57 to a first reduction pulley 71 of a reduction mechanism W, from which it travels via a second endless belt 72 to a second reduction pulley 73, further, it is transmitted via a first gear 74 to a seventh gear 80 and a drive gear 81 to a main pulley 63, from which it is transmitted via a third endless belt 69 and a drive pulley 59. The rotation drive force is transmitted via a connecting shaft 52 to a supporting member 51 which is therefore rotated, so that an original cover is automatically opened/closed according to a rotation direction of the drive motor 56. In this case, a drive case 55 itself rotates together with the supporting member 51 and a lifting member 54.

The remaining operation and effect are the same as those as described above with regard to embodiment 1, and thus description is omitted.

A device as above described in this embodiment 2 is slightly more complicated than that in embodiment 1, but the object of the present invention can be also achieved if implemented in this manner.

The present invention, designed as described in the foregoing, is suitable in use for automatic opening/closing devices of opening/closing members for various opened/closed members, such as office equipments in particular copying machine, printing machine and scanner.

The invention claimed is:

1. An automatic original cover operator for a copying machine, said automatic original cover operator comprising:

a hinge part and a driving part to drive said hinge part, said hinge part comprising:

a mounting member having a bottom plate and two side plates extending upward from side portions of said bottom plate, said bottom plate attached to an upper portion of a main body of said copying machine;

a supporting member comprising a top plate and two side plates extending downward from side portions of said top plate, said side plates of said supporting member being rotatably mounted on said side plates of said mounting member via a main shaft so that the supporting member is rotatable with said main shaft;

a lifting member having a top plate fixed to an original cover of said copying machine and having two side plates extending downward from side portions of said top plate of said lifting member, said side plates of said lifting member rotatably mounted on said side plates (51*b*,51*b*) of said supporting member via a drive shaft;

a compression spring interposed between said mounting member and said lifting member, said compression spring adapted to urge said lifting member in an opening direction of said original cover such that said lifting member overlaps said supporting member; and a rotation controlling mechanism for said lifting member comprising: a first locking member having a pair of engagement recess portions on one side portion thereof, said first locking member fixed to said main shaft and provided adjacent to one of said side plates of said supporting member, a second locking member having a pair of engagement convex portions disposed within said pair of engagement recess portions, having an engagement portion, and having a locking portion, said second locking member rotatably mounted on said main shaft and provided adjacent to said first locking member, a locking pin mounted on one of said side plates of said lifting member and engaged with said engagement portion of said second locking member, a tension coil spring interposed between said locking portion of said second locking member and a pin in order to urge the engagement of said engagement portion with said locking pin;

wherein said driving part comprises:

a drive case mounted on said main shaft and connected to said drive shaft;

a drive motor mounted to said drive case, said drive motor being adapted to rotate said main shaft; and a reduction mechanism mounted in said drive case and transmitting a rotation drive force from said drive motor to said main shaft via an electromagnetic clutch;

wherein said driving part is rotatable together with said supporting member when said original cover opens and closes.

2. The automatic original cover operator according to claim 1, wherein said hinge part further comprises a fluid damper device operating at a predetermined closing angle of said original cover relative to said upper portion of said main body.

3. An office equipment comprising said automatic original cover operator according to claim 1.

4. The automatic original cover operator according to claim 1, further comprising a first spring receiving member swingably supported on said mounting member via locking pins, a second spring receiving member slidably receiving said first spring receiving member and swingably supported on said lifting member, and said compression spring resiliently provided in said first spring receiving member and said second spring receiving member.

* * * * *